US011149462B1

(12) United States Patent
Jee et al.

(10) Patent No.: US 11,149,462 B1
(45) Date of Patent: Oct. 19, 2021

(54) CONFIGURABLE MODULAR SHELTER SYSTEM

(71) Applicant: U.S. Government as Represented by the Secretary of the Army, Natick, MA (US)

(72) Inventors: Melvin W. Jee, Whitinsville, MA (US); Conor R. Hennessy, Brighton, MA (US)

(73) Assignee: U.S. Government as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/926,801

(22) Filed: Jul. 13, 2020

Related U.S. Application Data

(60) Continuation of application No. 16/780,973, filed on Feb. 4, 2020, now abandoned, and a division of application No. 15/715,218, filed on Sep. 26, 2017, now Pat. No. 10,590,671.

(51) Int. Cl.
*E04H 9/04* (2006.01)
*E04B 1/343* (2006.01)
*E04H 1/12* (2006.01)

(52) U.S. Cl.
CPC ..... *E04H 9/04* (2013.01); *E04B 1/34321* (2013.01); *E04H 1/1205* (2013.01); *E04B 2001/34389* (2013.01)

(58) Field of Classification Search
CPC ..... E04B 1/34321; E04B 2001/34389; E04H 1/1205; E04H 9/04
See application file for complete search history.

(56) References Cited

U.S. PATENT DOCUMENTS 3,820,294 A 6/1974 Parker
6,299,011 B1 * 10/2001 Rosenfeldt ..... B65D 19/0028 220/4.29
6,948,280 B2 * 9/2005 Marcinkowski .... E04B 1/34321 446/478
6,981,347 B1 1/2006 Walburger
7,677,006 B2 3/2010 Rozenberg
7,984,594 B1 7/2011 Propst
8,065,846 B2 11/2011 McDonald et al.
8,136,324 B2 * 3/2012 Browning ..... E04C 2/296 52/588.1
8,397,461 B2 * 3/2013 Browning ..... E04C 2/296 52/588.1
8,555,559 B2 * 10/2013 DiGregory ..... E04B 1/3445 52/79.5

(Continued)

*Primary Examiner* — Andrew J Triggs
(74) *Attorney, Agent, or Firm* — Roger C Phillips

(57) ABSTRACT

A modular shelter system includes a floor panel having a first curved surface along a lateral edge on a top side of the floor panel and a first inside surface located inside of the first curved surface. The modular shelter system additionally includes a wall panel having a second curved surface along a bottom end of the wall panel, wherein the second curved surface is configured to rotate relative to the first curved surface, and wherein the second curved surface is configured to mate with the first curved surface. The wall panel further has a second inside surface located inside of the second curved surface, wherein the second inside surface is configured to mate with the first inside surface when the wall panel is erected over the floor panel.

3 Claims, 24 Drawing Sheets

(56) References Cited

U.S. PATENT DOCUMENTS

| | | | | |
|---|---|---|---|---|
| 8,707,631 | B2 * | 4/2014 | Scouten | E04B 1/3445 52/66 |
| 8,720,126 | B2 * | 5/2014 | Strickland | E04B 1/3442 52/79.5 |
| 8,763,315 | B2 * | 7/2014 | Hartman | E04B 1/34357 52/79.5 |
| 8,973,335 | B2 | 3/2015 | Wilson | |
| 9,027,298 | B1 | 5/2015 | Martinez | |
| 9,109,354 | B2 | 8/2015 | Toubia et al. | |
| 9,416,528 | B2 * | 8/2016 | Schaffert | E04B 1/3445 |
| 9,441,358 | B2 * | 9/2016 | Hartman | E04H 1/005 |
| 2002/0145136 | A1 | 10/2002 | Connelly, Jr. et al. | |
| 2008/0047217 | A1 * | 2/2008 | Browning | E04B 1/34321 52/588.1 |
| 2011/0126487 | A1 * | 6/2011 | Browning | E04B 1/34321 52/586.1 |
| 2011/0290291 | A1 * | 12/2011 | Neal | E04H 1/1244 135/96 |
| 2013/0019913 | A1 * | 1/2013 | Zadok | E04H 15/48 135/96 |
| 2013/0305626 | A1 * | 11/2013 | Strickland | E04B 1/34384 52/79.5 |
| 2014/0109495 | A1 * | 4/2014 | Segall | G09B 9/003 52/173.1 |
| 2014/0311053 | A1 * | 10/2014 | Hartman | E04B 1/3445 52/79.5 |
| 2015/0033639 | A1 | 2/2015 | Wilson | |
| 2016/0010324 | A1 | 1/2016 | Thrall et al. | |

* cited by examiner

CONFIGURABLE MODULAR SHELTER SYSTEM

STATEMENT OF GOVERNMENT INTEREST

The material described herein may be manufactured and used by or for the U.S. Government for governmental purposes without the payment of any royalties thereon or therefor.

FIELD OF THE DISCLOSURE

The present disclosure relates generally to temporary shelters and more specifically to temporary modular shelters which can be erected and taken down without a need for tools.

BACKGROUND

Shelters afford protection when needed. For particular situations, shelter needs are specific, such as with animal shelters, bus shelters, homeless shelters, or bomb shelters, for example. In other situations, shelter designs are more general to serve multiple purposes. A home, for instance, is often a permanent structure made to shield against weather and unwanted incursions while furnishing its occupants with comfort and the amenities of day-to-day living.

In emergency applications, the need for a shelter is usually immediate with the location of the shelter being unknown until the emergency occurs. The typical shelter is made by a minimum number of persons. In some cases, a building on location is appropriated for emergency use or a mobile shelter is driven to the emergency. In other cases, however, the emergency occurs in a remote area with limited access and no preexisting structures.

In military applications, shelter needs are mission specific. With operating troops and transported gear being allocated to meeting mission objectives, resources for shelter building are usually at a minimum, particularly in remote locations. Small unit operations are typically conducted from makeshift shelters constructed using locally available building materials. Some structures made in this fashion are manpower intensive, require the significant use of tools, and cannot be reused.

BRIEF DESCRIPTION OF THE FIGURES

The accompanying figures, for which like reference numerals refer to identical or functionally similar elements throughout the separate views, together with the detailed description below, are incorporated in and form part of the specification. The figures serve to illustrate embodiments of concepts included in the claims and to show various features and advantages of those embodiments.

Figure 1:
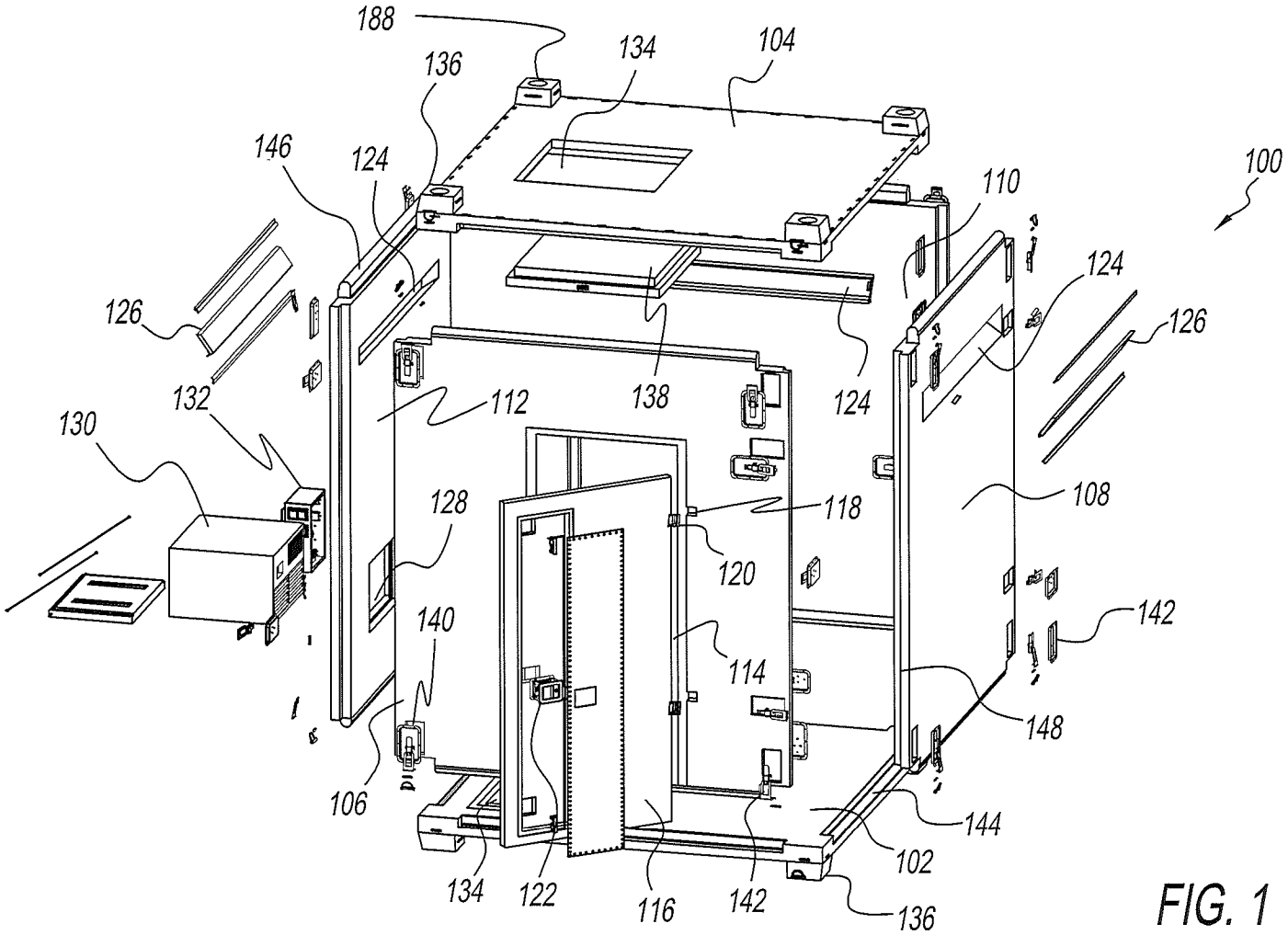
FIG. 1 shows an exploded view of a single modular unit of a modular shelter system, in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

The system, apparatus and method components have been represented, where appropriate, by conventional symbols in the drawings, showing only those specific details that are pertinent to understanding the embodiments of the present teachings so as not to obscure the disclosure with details that will be readily apparent to those of ordinary skill in the art having the benefit of the description herein.

SUMMARY

Generally speaking, pursuant to various embodiments described herein, the present disclosure provides a modular shelter system (MSS) and method for deploying the same. More specifically, different embodiments of the MSS system have interchangeable components and are designed to meet the needs of emergency and/or military applications. The MSS, for example, can be erected on various types of uneven or rough terrain without the use of tools and its components are stackable for transport.

In accordance with the teachings herein, components of a MSS include a first floor panel having a first curved surface along a lateral edge on a top side of the first floor panel and a first inside surface located inside of the first curved surface. Components of the MSS additionally include a first wall panel having a second curved surface along a bottom end of the first wall panel, wherein the second curved surface is configured to rotate relative to the first curved surface, and wherein the second curved surface is configured to mate with the first curved surface. The first wall panel further has a second inside surface located inside of the second curved surface, wherein the second inside surface is configured to mate with the first inside surface. For particular embodiments, the first curved surface is concave and the second curved surface is convex or the first curved surface is convex and the second curved surface is concave.

For one embodiment, the first floor panel of the MSS also has a first outside surface located outside of the first curved surface, and the first wall panel of the MSS also has a second outside surface located outside of the second curved surface, wherein the second outside surface is configured to mate with the first outside surface. In a further embodiment, the first outside surface is lower than the first inside surface when the first floor panel is level and facing upward. Also, the second outside surface is lower than the second inside surface along the bottom end of the first wall panel when the first wall panel is erected in a vertical position.

In a number of embodiments, the first floor panel of the MSS is multisided with a plurality of lateral edges on the top side of the first floor panel, wherein along each lateral edge of the plurality of lateral edges of the first floor panel is the first curved surface and the first inside surface located inside of the first curved surface. For these embodiments, the MSS includes a plurality of wall panels, wherein each wall panel of the plurality of wall panels has the second curved surface along the bottom end of the wall panel and the second inside surface located inside of the second curved surface. Further, each wall panel of the plurality of wall panels is interchangeable in that the second curved surface along the bottom end of any wall panel of the plurality of wall panels can mate with the first curved surface along any lateral edge of the plurality of lateral edges of the first floor panel. In some instances, two or more wall panels of the plurality of wall panels have different feature configurations from the other wall panels of the plurality of wall panels.

Several embodiments of the MSS also include a first ceiling panel, wherein the first ceiling panel is multisided with a plurality of lateral edges on a bottom side of the first ceiling panel. Along each lateral edge of the plurality of lateral edges of the first ceiling panel is the first curved surface and the first inside surface located inside of the first curved surface, wherein the first ceiling panel and the first floor panel are interchangeable.

With some embodiments of the MSS which include the first ceiling panel, each wall panel of the plurality of wall panels of the MSS further includes the second curved surface along a top end of the wall panel, wherein the second curved surface along the top end of the wall panel is configured to mate with the first curved surface along any edge on the bottom side of the first ceiling panel. Additionally, each wall panel of the plurality of wall panels also includes the second inside surface located inside of the second curved surface at the top end of the wall panel, wherein the second inside surface at the top end of the wall panel is configured to mate with the first inside surface along any edge on the bottom side of the first ceiling panel.

With a number of embodiments, the first floor panel, a set of wall panels of the plurality of wall panels, and the first ceiling panel interconnect to form a single shelter unit. For some of these embodiments, the first floor panel, the set of wall panels, and the first ceiling panel forming the single shelter unit are secured in place using a first set of latches to secure the wall panels of the set of wall panels to the first floor panel, a second set of latches to secure the wall panels of the set of wall panels to one another, and a third set of latches to secure the wall panels of the set of wall panels to the first ceiling panel.

For several embodiments, the MSS includes at least one deformable seal, wherein the at least one deformable seal is attached to one or both of the first curved surface and the second curved surface. The at least one deformable seal, for example, creates an airtight and/or watertight seal between a wall panel and a floor or ceiling panel of the MSS.

In an embodiment, one or more wall panels of the MSS include integrated electrical wiring. The integrated electrical wiring, for example, transmits electric current from a power module attached to one wall panel of the MSS to an electrical outlet attached to another wall panel of the MSS.

With multiple embodiments, the first floor panel of the MSS further includes a plurality of support blocks on its bottom side, wherein each support block of the plurality of support blocks accommodates a jack for raising and lowering the support block to level the first floor panel. In further embodiments, at least one support block of the plurality of support blocks on the bottom side of the first floor panel include one or more level indicators to indicate levelness in one or more directions. For additional embodiments, the first ceiling panel of the MSS also has a plurality of support blocks on its top side, wherein each support block on the top side of the first ceiling panel mates with a support block on a bottom side of a second floor panel when stacking single shelter units into a stacked double shelter unit with the second floor panel over the first ceiling panel.

In some embodiments, the first ceiling panel and the second floor panel of the MSS each include a hatchway, wherein the hatchway of the first ceiling panel aligns with the hatchway of the second floor panel in the stacked double shelter unit. In further embodiments, the MSS also has an interconnection sleeve, wherein the interconnection sleeve extends from the hatchway of the first ceiling panel to the hatchway of the second floor panel.

With several embodiments, the MSS includes a plurality of wall interconnection panels configured to laterally interconnect between two wall panels or between one wall panel and another wall interconnection panel. The MSS also includes one or more floor interconnection panels configured to laterally interconnect between two floor panels and to vertically connect to the bottom ends of two or more wall interconnection panels. Each floor interconnection panel can be flipped over and used as a ceiling interconnection panel configured to laterally interconnect between two ceiling panels and to vertically connect to the top ends of two or more wall interconnection panels. For example, one floor interconnection panel, one ceiling interconnection panel, and two wall interconnection panels can replace one wall panel on each of two single shelter units to interconnect the two single shelter units into a laterally interconnected double shelter unit. The floor interconnection panels, ceiling interconnection panels, and wall interconnection panels can also laterally interconnect single shelter units into a chain of three or more shelter units extending in one or more lateral directions.

Some or all of the wall panels of the MSS can have multiple layers of different materials. For instance, at least one of the multiple layers includes a thermally insulating material or a ballistic-resistant material.

In another embodiment, a wall panel of the MSS includes a window opening and a floor panel of the MSS is separable into first and second sections. Further, the first section of the floor panel connects with the wall panel to form a two-panel firing position. The two-panel firing position can also include at least one support brace connected to the first section of the floor panel on one end and to the wall panel on the other end.

Also in accordance with the teachings herein is a method for deploying an MSS. The method includes placing a floor panel of the MSS down with a top side of the floor panel up, wherein the floor panel has a first groove located along a first lateral edge on the top side of the floor panel and a first inside-the-groove surface located inside of the first groove. The method additionally includes placing a first protrusion, located along a bottom end of a first wall panel of the MSS, at the first groove with a top end of the first wall panel tipped back away from the floor panel, wherein the first wall panel further has a first inside-the-protrusion surface located inside of the first protrusion. The method continues with rotating the first wall panel upward with the first protrusion in the first groove until the first wall panel is vertical over the floor panel and dropping the first protrusion into the first groove until the first inside-the-protrusion surface mates with the first inside-the-groove surface.

In a further embodiment, the method for deploying the MSS also includes placing a second protrusion, located along a bottom end of a second wall panel of the modular shelter system, at a second groove, located along a second lateral edge on the top side of the floor panel, with a top end of the second wall panel tipped back away from the floor panel, wherein the second wall panel further has a second inside-the-protrusion surface located inside of the second protrusion, and wherein the floor panel further has a second inside-the-groove surface located inside of the second groove. The method additionally includes rotating the second wall panel upward with the second protrusion in the second groove until the second wall panel is vertical over the floor panel and a second edge profile on a lateral edge of the second wall panel mates with a first edge profile on a lateral edge of the first wall panel. The method continues with lowering the second protrusion into the second groove until the second inside-the-protrusion surface mates with the second inside-the-groove surface.

DETAILED DESCRIPTION

The following detailed description references the accompanying figures in describing exemplary embodiments consistent with this disclosure. The exemplary embodiments are provided for illustrative purposes and are not exhaustive. Additional embodiments not explicitly illustrated or described are possible. Further, modifications can be made to presented embodiments within the scope of the present teachings. The detailed description is not meant to limit this disclosure. Rather, the scope of the present disclosure is defined only in accordance with the presented claims and equivalents thereof.

FIG. 1 shows an exploded view of a single modular unit 100 of a MSS. The single modular unit 100, also referred to as an MSS unit, is shown to include: a floor panel 102; a ceiling panel 104; and four wall panels 106, 108, 110, 112 configured with a plurality of latch recesses 140 to accommodate latches 142 used in securing the six pictured panels 102, 104, 106, 108, 110, 112 when interconnected.

In each of the outside corners of the floor 102 and ceiling 104 panels, a support block 136 is shown with a recess 188 at its center. Between the support blocks 136, along the edges on the insides of the floor 102 and ceiling 104 panels, are interconnection grooves 144 configured to mate with interconnection tongues 146 located at the bottom and top ends of the wall panels 106, 108, 110, 112.

As used herein, the words "inside" and "outside" are relative terms that indicate a location, side, or direction with respect to an inside and an outside, respectively, of an MSS unit. The inside surfaces of a floor panel and a ceiling panel, for example, are the upward- and downward-facing, respectively, surfaces of the floor panel and the ceiling panel as orientated in an assembled MSS unit.

For pictured embodiments, the interconnection grooves 144 represent the first curved surface of the floor 102 and ceiling 104 panels, and the interconnection tongues 146 represent the second curved surface of the wall panels 106, 108, 110, 112. The first curved surface 144 and the second curved surface 146 are also referred to as a groove and a protrusion, respectively.

The floor 102 and ceiling 104 panels pictured in FIG. 1 are shown to each include a hatchway 134 with a hatch cover 138. In one embodiment, one side of the hatch cover 138 is rotatably hinged to the floor 102 or ceiling 104 panel and another side is latched to the floor 102 or ceiling 104 panel. For a different embodiment, the hatch cover 138 is not rotatably hinged and latches to the floor 102 or ceiling 104 panel on two or more sides. For other embodiments, there is no hatch in the floor 102 or ceiling 104 panel.

The floor 102 and ceiling 104 panels are swappable in that the floor panel 102 can be flipped over and used as the ceiling panel 104, and the ceiling panel can be flipped over and used as the floor panel 102. The floor 102 and ceiling 104 panels are also interchangeable, meaning each of the panels 102, 104 can be switched out for another floor or ceiling panel having a different configuration.

Like the floor 102 and ceiling 104 panels, the wall panels 106, 108, 110, 112 are also swappable and interchangeable. Any wall panel shown can be erected in the position of any other wall panel and/or be replaced by a wall panel having a different configuration. Further, any combination and number of wall panels can be of a different or the same configuration. The wall panels 106, 108, 110, 112 also feature a joint profile 148 on their left and right lateral edges configured to join each wall panel with its two adjacent wall panels in the MSS unit 100.

The wall panel 106 is configured with a doorway 114 and a door 116. The doorway 114 includes hinge recesses 118 configured to accommodate hinges 120 used to interconnect the wall panel 106 with the door 116 in a way that allows the door 116 to be opened and closed. To facilitate the opening and closing of the door 116, the door 116 also includes a door handle 122 to operate a door latching mechanism.

The wall panels 108, 110, and 112 are each configured with a slotted opening 124. Under different use scenarios, the slotted openings 124 can be used for observation, ventilation, and/or as firing ports. Slot covers 126 can be used with latches or latches and hinges to close the slotted openings 124 when desired.

In addition to the slotted opening 124, the wall panel 112 also features an opening 128 to accommodate a heating, ventilation, and/or air conditioning (e.g., heating, ventilating and air conditioning (HVAC)) unit 130. Another opening (not shown) accommodates a power module 132 providing access to electricity from the inside of the MSS unit 100.

A limited number of MSS unit 100 components 102, 104, 106, 108, 110, 112, 114, 116, 118, 120, 122, 124, 126, 128, 130, 132, 134, 136, 138, 140, 142, 144, 146, 148, 188 are described in FIG. 1 for ease of illustration. Additional embodiments may include a lesser or greater number of such components configured similarly or differently in an MSS unit. Moreover, other components needed for a commercial and/or military embodiment of an MSS unit that incorporates the components shown for the MSS unit 100 are omitted from FIG. 1 for clarity in describing enclosed embodiments. The features and operations of the MSS unit 100 components 102, 104, 106, 108, 110, 112, 114, 116, 118, 120, 122, 124, 126, 128, 130, 132, 134, 136, 138, 140, 142, 144, 146, 148, 188 pictured in FIG. 1, and of those components included in other embodiments consistent with the teachings herein, are described with reference to the remaining figures.

Figure 2:
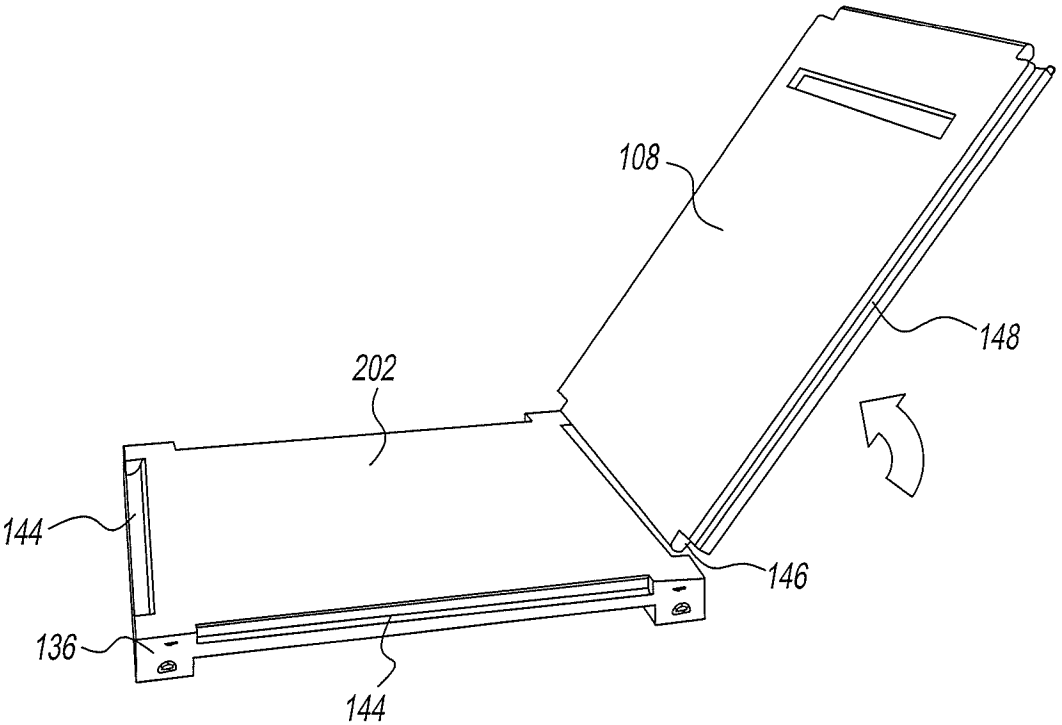
FIG. 2 shows a perspective view of an interchangeable wall panel being rotated into place on an interchangeable floor panel, in accordance with some embodiments.
Figure 3:
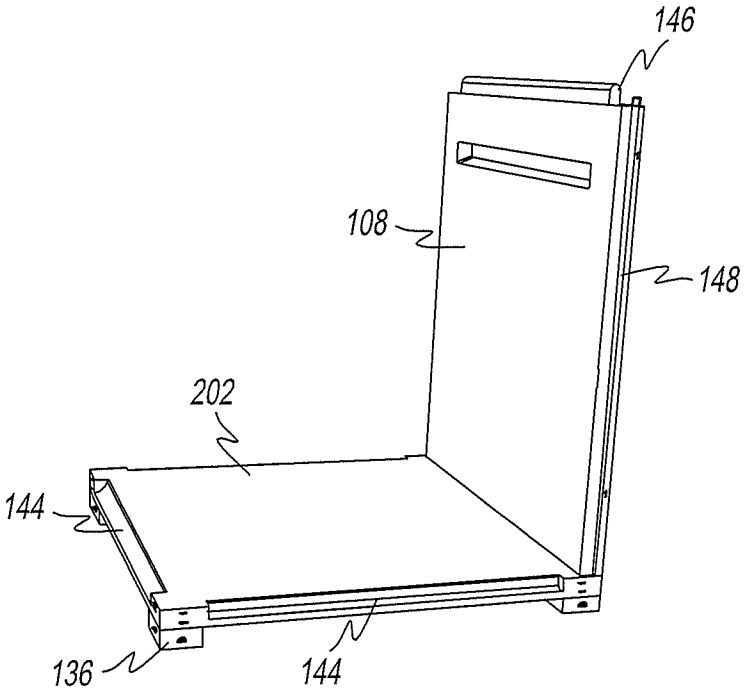
FIG. 3 shows a perspective view of an interchangeable wall panel interconnected with an interchangeable floor panel, in accordance with some embodiments.

FIGS. 2 and 3 show an initial stage in the assembly of the MSS unit 100, namely, the interconnection of the first wall panel 108 with a floor panel 202. For illustrative purposes only, the one-piece floor panel 202 is depicted as not including the optional hatchway 134. The interconnection grooves 144 running between the support blocks 136 and along the four edges of the floor panel 202 make the panel 202 interchangeable with the floor panel 102 and other floor panels having different configurations.

In some embodiments, the MSS panels are of a size and weight where two persons can conduct the assembly of the MSS unit 100 without the assistance of others. In other embodiments, a single person or three or more persons may assemble the MSS unit 100.

Assuming two-person assembly, the assemblers insert the interconnection tongue 146 at the bottom of the wall panel 108 into any of the four interconnection grooves 144 on the floor panel 202. The assemblers then rotate the wall panel 108 upward, as shown in FIG. 2, until the wall panel 108 is in a vertical position over the floor panel 202, as shown in FIG. 3. With the wall panel 108 in place, the joint profiles 148 on its lateral sides are each ready to mate with the joint profile 148 of an adjacent wall panel.

Figure 4:
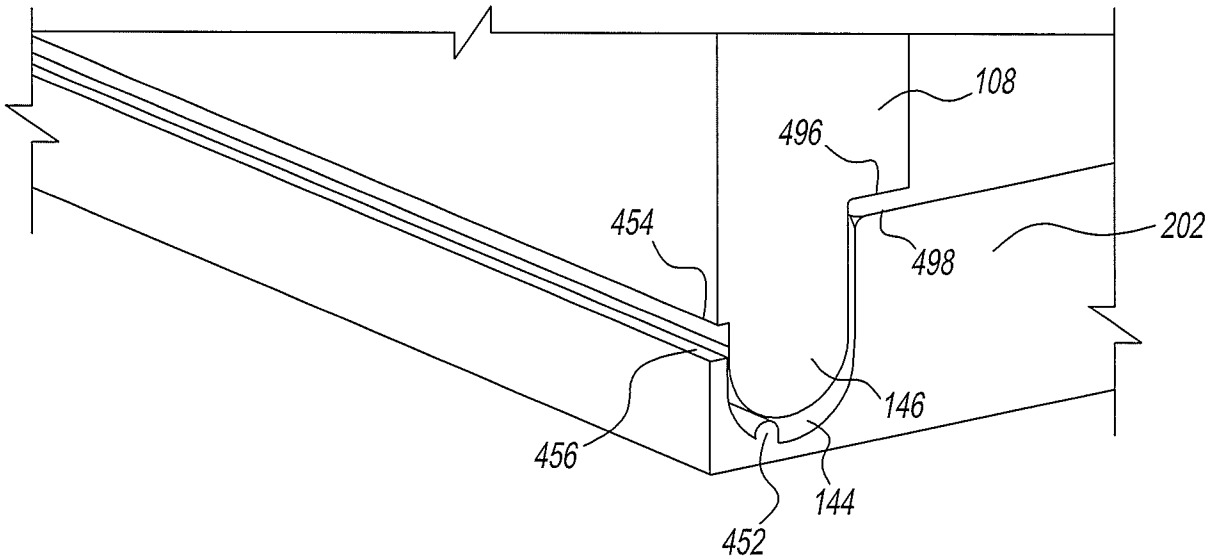
FIG. 4 shows a perspective view of a tongue-and-groove joint between an interchangeable wall panel and an interchangeable floor panel, in accordance with some embodiments.

FIG. 4 shows a cross section of the joining of the interconnection tongue 146 at the base of the wall panel 108 with the interconnection groove 144 on the upper surface of the floor panel 202. Running lengthwise at the bottom of the interconnection groove 144 is shown a deformable seal 452, also referred to simply as a seal, protruding into the interconnection groove 144. When the wall panel 108 is rotated into its vertical position, the interconnection tongue 146 is seated in the interconnection groove 144 over the seal 452. For some embodiments, the seal 452 is made from an elastic material which deforms under the weight of the wall panel 108. In one embodiment, the seal 452 deforms when a force is applied to the wall panel 108 to urge the interconnection tongue 146 into the interconnection groove 144. As the seal 452 deforms, the interconnection tongue 146 sinks deeper into the interconnection groove 144.

On the inside of the wall panel 108 is a downward-facing horizontal shelf 496 resulting from the width of the interconnection tongue 146 being less than the width of the wall panel 108. Opposing the downward-facing horizontal shelf 496 of the wall panel 108 is an upward-facing horizontal surface 498 of the floor panel 202. For pictured embodiments, the upward-facing horizontal surface 498 represents the first inside surface of the floor panel 202, and the downward-facing horizontal shelf 496 represents the second inside surface of the wall panel 108. The surface 498 and the surface 496 are also referred to as an inside-the-groove surface and an inside-the-protrusion surface, respectively.

On the outside of the wall panel 108 is another downward-facing horizontal shelf 454. Opposing the downward-facing horizontal shelf 454 of the wall panel 108 is an upward-facing horizontal surface 456 of the floor panel 202. For pictured embodiments, the upward-facing horizontal surface 456 represents the first outside surface of the floor panel 202, and the downward-facing horizontal shelf 454 represents the second outside surface of the wall panel 108. The surface 456 of the floor panel 202 is lower than the surface 498 of the floor panel 202 to facilitate placing the interconnection tongue 146 of the wall panel 108 into the interconnection groove 144 before rotating the wall panel 108 up into its vertical position.

As the wall panel 108 is rotated into position, the interconnection tongue 146 continues to drop into the interconnection groove 144. As the interconnection tongue 146 comes into contact with the seal 452, the seal 452 deforms under the weight of the wall panel 108. The interconnection tongue 146 continues to sink into the interconnection groove 144 until the inside horizontal shelf 496 of the wall panel 108 comes into contact with the inside surface 498 of the floor panel 202, and the outside horizontal shelf 454 of the wall panel comes into contact with the outside surface 456 of the floor panel 202.

In several embodiments, an airtight and/or watertight seal is created in the interconnection groove 144 between the interconnection tongue 146 and the deformed seal 452. For some of these embodiments, the seal is extended by placing a gasket or sealing material in the interface between the surfaces 496 and 498 and/or in the interface between the surfaces 454 and 456. The seal can keep chemical agents or noxious gases out of the MSS unit 100 during military or emergency applications. For one embodiment, the design of the interconnection groove 144 is such that any water penetrating the interface between the horizontal shelves 454 and 456 cannot rise to the height of the interface between the surfaces 496 and 498, if the water penetrates past the seal 452.

Figure 5:
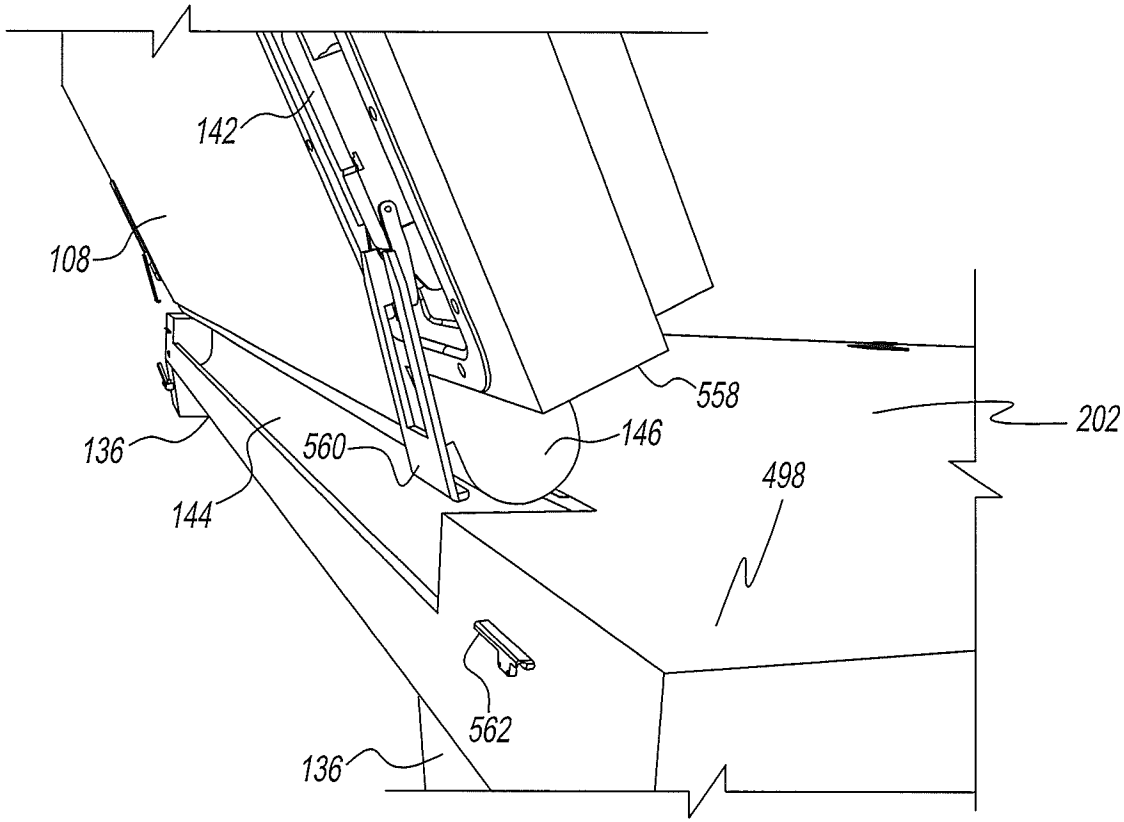
FIG. 5 shows a perspective view of a tongue-and-groove joint between an interchangeable wall panel and an interchangeable floor panel with accompanying latches, in accordance with some embodiments.

FIG. 5 shows a perspective view of an embodiment of an edge of the floor panel 202 where it mates with the bottom end of the wall panel 108. The length of the interconnection groove 144 is shorter than the total edge length of the floor panel 202 to accommodate the support blocks 136 located at the corners of the floor panel 202. To fit in the interconnection groove 144, the interconnection tongue 146 of the wall panel 108 is shorter than the width of the wall panel 108. This leaves a notch 558 at each end of the bottom of the wall panel 108 to accommodate the support blocks 136 of the floor panel 202. Because floor and ceiling panels are interchangeable, the top end of the wall panel 108 is similarly configured to its bottom end with the notches 558 and the interconnection tongue 146 running between the notches 558.

When the interconnection tongue 146 is fully inserted into the interconnection groove 144, the ends of the interconnection tongue 146 are flush against the inside surfaces of the support blocks 136 at the ends the interconnection groove 144. Also, a bottom surface of the notch 558 at each of the lower ends of the wall panel 108 sit flush atop the upper surface 498 of the floor panel 202. For one embodiment, the surfaces at the ends of the interconnection groove 144 and interconnection tongue 146 are squared off. In another embodiment, these surfaces are tapered in a way which allows the ends of the interconnection tongue 146 to meet flush with the ends of the interconnection groove 144.

For some embodiments, the edges of the wall panels 108 and 110 are designed so that once 108 is erected correctly over the floor panel 202, the wall panel 110 can only be erected in a proper upright orientation. The joint profiles 148 on the wall panels 108 and 110 are designed to mate only when the wall panels 108, 110 are correctly orientated relative to one another. For example, the wall panel 110 cannot be flipped or rotated and still mate with the wall panel 108. Further, latches interconnecting the wall panels 108 and 110 will not align under an incorrect orientation between the wall panels 108, 110.

With a number of embodiments, the mating of the interconnection grooves 144 with the interconnection tongues 146 prevents the MSS unit 100 from collapsing should all of the latches or other fastening means between the wall and/or floor panels become disengaged. For one embodiment, adhesive can be applied between the interconnection groove 144 and interconnection tongue 146, between the surfaces 496 and 498, between the surfaces 454 and 456, and/or between the joint profiles 148 of the wall panels to make the construction of MSS unit 100 permanent, for example, after removing the seal 452.

As with the interfaces between the surfaces 498 and 496 and the surfaces 456 and 454, a gasket or sealing material can be placed between the upper surface 498 of the floor panel 202 and the lower surface of the notches 558. In a particular embodiment, a sealing gasket used between the surfaces 498 and 496 extends into the interstitial space between the upper surface 498 of the floor panel 202 and the lower surface of the notches 558 when the wall panel 108 is seated in the interconnection groove 144.

With the wall panel 108 in place, the interconnection between wall panel 108 and the floor panel 202 is secured using the latches 142 near the bottom end of the wall panel 108. For each latch 142, a latch arm 560 engages a latch anchor 562 on an end of the floor panel 202. When the latches 142 are closed, the latch arms 560 hold the floor 202 and wall 108 panels together. In the embodiment shown, the latches 142 are located on the outside of the wall panel 108. In other embodiments, the latches 142 are located on the wall panel 108 and/or the floor panel 202 in any combination. For another embodiment, the latches 142 are located on inside surfaces of the wall panels 106, 108, 110, 112. Having the latches 142 on the inside surfaces of the wall panels 106, 108, 110, 112, for example, can guard against the MSS unit 100 being unlatched from the outside while persons are sheltering inside the unit 100.

Figure 6:
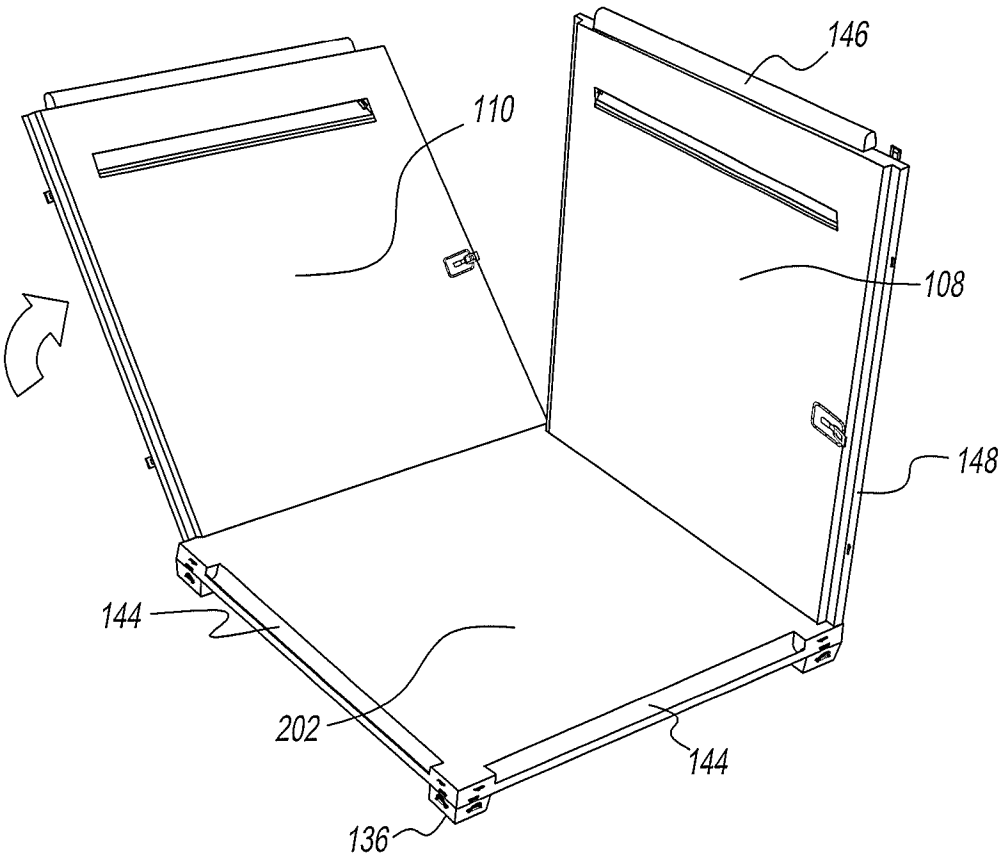
FIG. 6 shows a perspective view of a second interchangeable wall panel being rotated into place on an interchangeable floor panel, in accordance with some embodiments.

FIG. 6 shows a continuation of the assembly process for the MSS unit 100. The assemblers place the interconnection tongue 146 located at the bottom end of the second wall panel 110 into another interconnection groove 144 on the floor panel 202 adjacent to the first wall panel 108. The assemblers then rotate the wall panel 110 into its upright vertical position so the two opposing joint profiles 148, on the lateral side of each wall panel 108, 110, meet. This forms a corner between the two wall panels 108, 110. The joint profile 148 of the wall panel 110 then slides along the joint profile 148 of the wall panel 108 as the wall panel 110 drops into its interconnection groove 144.

Figure 7:
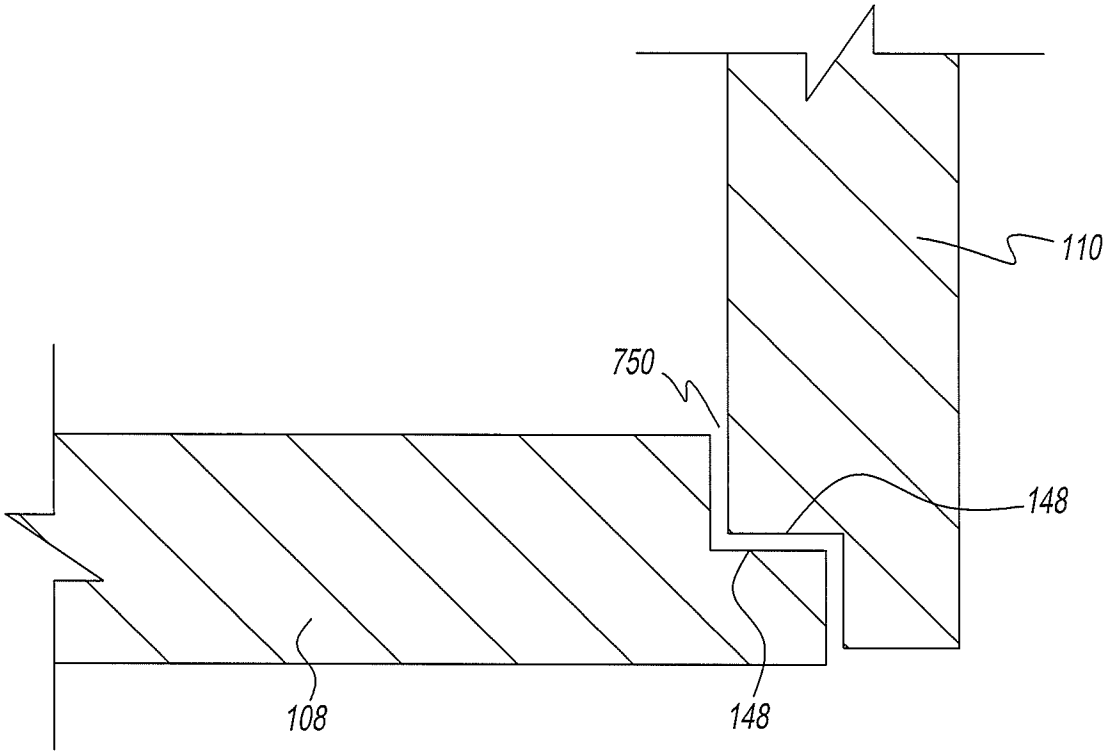
FIG. 7 shows a top-down cross-sectional view of a tiered lap joint between interchangeable wall panels, in accordance with some embodiments.

FIG. 7 provides a top-down cross-sectional view of the wall panels 108 and 110. As the wall panel 108 meets the wall panel 110 to form a corner, the joint profile 148 of the wall panel 108 meets the joint profile 148 of the wall panel 110 to form a corner joint 750. As shown, the corner joint 750 is a three-tiered lap joint having three pairs of opposing surfaces coming into contact with one another. In several embodiments, a seal material is placed on some or all of the joint profiles 148 so that after assembly, the seal material occupies the interstitial space between any number of pairs of opposing surfaces within the corner joint 750 to maintain an airtight and/or waterproof seal between the wall panels 108, 110. For a particular embodiment, only one joint profile 148 of each wall panel 106, 108, 110, 112 has seal material so that when the MSS unit 100 is assembled, only one layer of seal material occupies any corner joint 750.

Figure 8:
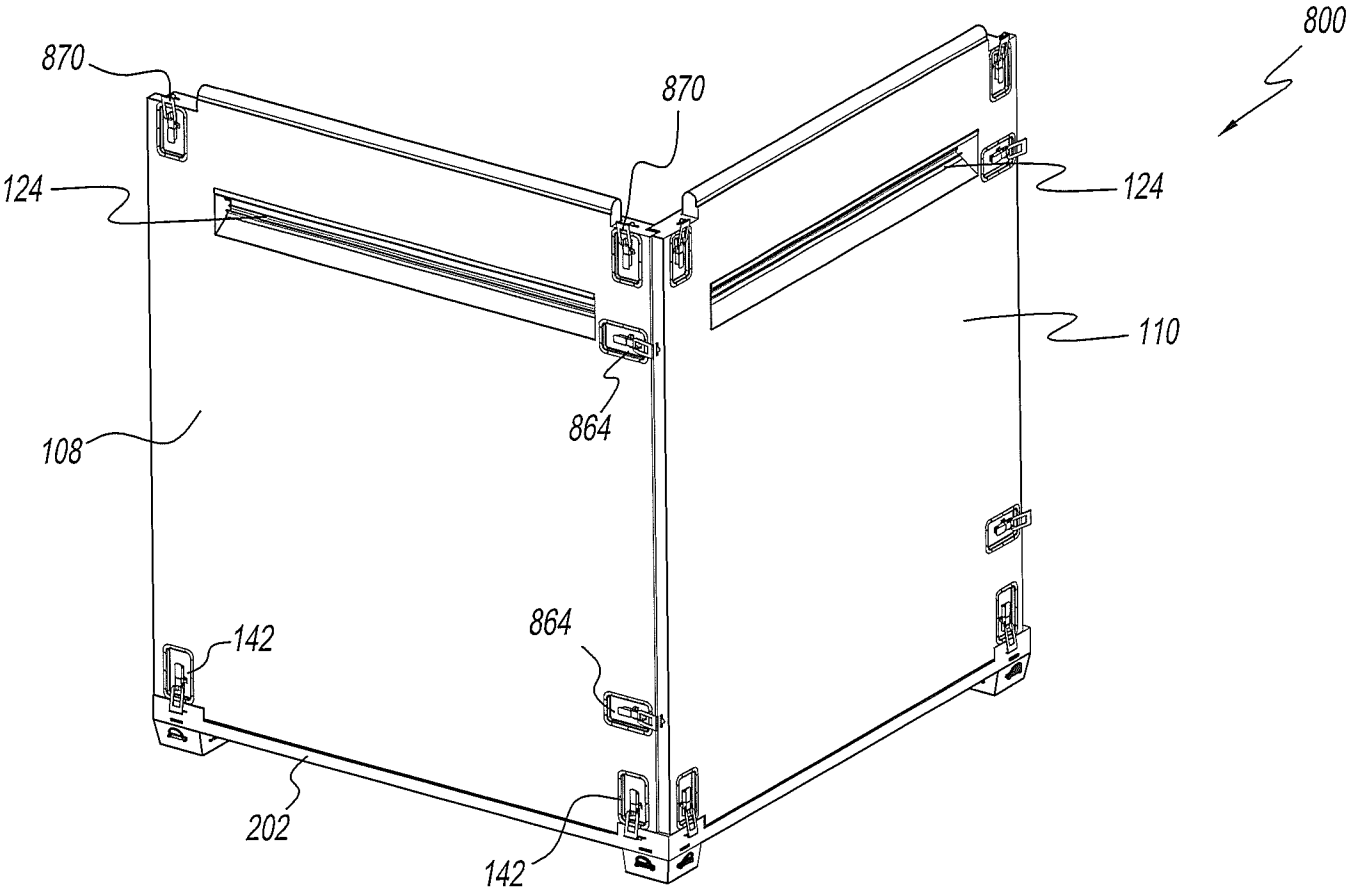
FIG. 8 shows a perspective view of adjacent interchangeable wall panels interconnected to an interchangeable floor panel, in accordance with some embodiments.

FIG. 8 shows a half-assembled MSS unit 800 with three panels 202, 108, 110 in place. Each panel is secured to the other two panels using a pair of latches. The wall panel 108, for example, is secured to the floor panel 202 by the latches 142 and is secured to the adjacent wall panel 110 to the right by latches 864. Latches 870 will secure the wall panel 108 to the ceiling panel after the ceiling panel 104 is placed. Two latch anchors (not visible) on the left end of the wall panel 108 will allow the wall panel 106, after it is placed, to be secured to the wall panel 108.

The latches 142, 864, 870 allow the assemblers to secure interconnected panels without the use of tools. For one embodiment, the latches are pan latches. In other embodiments, latches of various types are used. For some embodiments, a different mechanisms, such as ball-lock pins, ratchet straps, cam locks, etc., are used to secure the interconnected panels in place by hand.

With three interconnected panels 202, 108, 110 secured in place, the half-assembled MSS unit 800 stands stable. In a military application, the unit 800 can be used as a firing position, which offers cover on two sides and provides two slotted openings 124 for firing in multiple directions. Adding another wall panel with the slotted opening 124 to the unit 800 results in a firing position which offers cover from three directions. Another configuration for a firing position is described infra with reference to FIG. 15.

Figure 9:
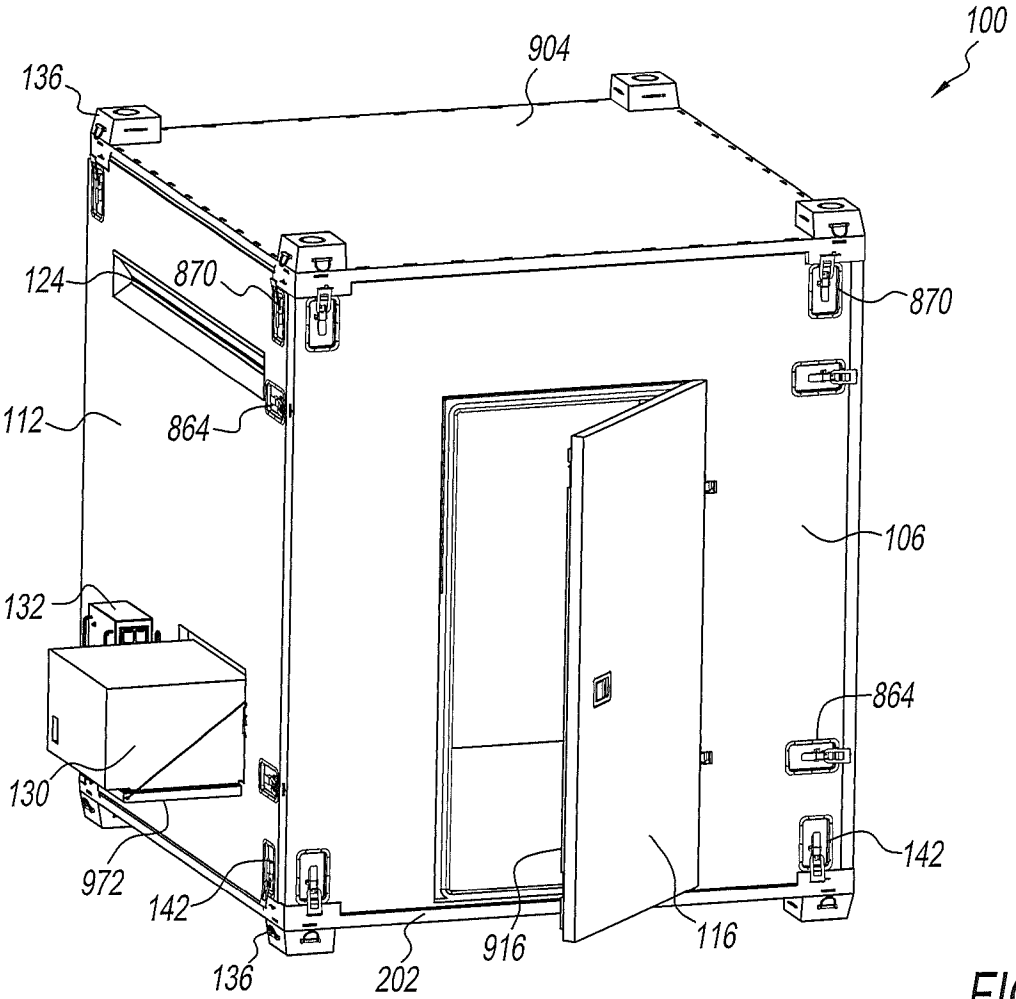
FIG. 9 shows a perspective view of an assembled modular unit of a modular shelter system, in accordance with some embodiments.

FIG. 9 shows the MSS unit 100 fully assembled with all six panels 202, 904, 106, 108, 110, 112 secured in place by the wall-to-floor 142, wall-to-wall 864, and wall-to-ceiling 870 latches. The wall-to-floor 142, wall-to-wall 864, and wall-to-ceiling 870 latches are also referred to as a first set of latches 142, a second set of latches 864, and a third set of latches 870, respectively. As pictured, the floor panel 202 without the hatchway 134 is substituted for the interchangeable floor panel 102 shown in FIG. 1; and the ceiling panel 904, which is simply the floor panel 202 flipped over, is substituted for the interchangeable ceiling panel 104 shown in FIG. 1.

For one embodiment, the wall, floor, and ceiling panels are approximately square with an edge length of approximately 7 feet, giving the MSS unit 100 an interior volume of approximately 343 cubic feet. In other embodiments, the edge length of the approximately square panels can be less or more than 7 feet. For different embodiments, the wall, floor, and ceiling panels are rectangular so a single assembled MSS unit resembles a cuboid. In different embodiments, the MSS 100 can accept any power modules 132 or HVACs 130 designed elsewhere.

In some embodiments, the wall, floor, ceiling, and any interconnection panels are made from lightweight composite materials, such as solid laminations of metal, plastic, fiber, and/or wood. In other embodiments, one or more layers of metal, plastic, fiber, and/or wood are bonded, using film, liquid, and/or aerosol adhesives, as an external layer or "skin" to a core material, such as foam. The core material can be continuous, such as solid foam, or patterned, such as in a metallic, plastic and/or fiber based honeycomb arrangement. Thermoset or thermoplastic resins can also be infused, injected, or formed into various panels. For several embodiments, fibers are integrated into the panels. In some instances, the fibers structurally reinforce the panels. In other instances, the fibers are thermally insulating to more effectively hold a comfortable temperature in the MSS unit 100 in hot or cold environments. Additional embodiments for panel construction are described infra with reference to FIG. 22.

In a hot environment, the HVAC unit 130 operates as an air conditioner to provide cool air inside the MSS unit 100. In one instance, the HVAC unit 130 draws in outside air, cools the air, and passes the cooled air to the interior of the MSS unit 100. In another instance, the HVAC unit 130 draws air from inside the MSS unit 100, cools the air, and returns the cooled air to the interior of the MSS unit 100. Recycling inside air is desirable, for example, when the outside air is polluted, such as near a crash site or fire.

In a cold environment, the HVAC unit 130 operates as a heater to provide warm air inside the MSS unit 100. In one instance, the HVAC unit 130 draws in outside air, heats the air, and passes the heated air to the interior of the MSS unit 100. In another instance, the HVAC unit 130 draws air from inside the MSS unit 100, heats the air, and returns the heated air to the interior of the MSS unit 100.

In a comfortable environment, the HVAC unit 130 operates as a ventilation system drawing outside air and introducing the air to the interior of the MSS unit 100 without first heating or cooling it. For some embodiments, the ventilation system incorporates an air filtration system, used when the door 116, hatchways 134, and slotted openings 124 are sealed, to protect occupants of the MSS unit 100 from inhaling airborne pollutants and toxic gases. The ventilation system, for example, draws air over an absorption substrate which removes particulate and/or gaseous hazards from the air before introducing the filtered air to the interior of the MSS unit 100. In various embodiments, different filter modules, separable from the HVAC unit 130 and having specific filter components, are attached to the unit 130 when needed and replaced when exhausted.

The power module 132 connects on the outside of the MSS unit 100 to an external source of electric power, such as to a solar panel, generator, extension cord, or power transmission line. In some embodiments, the power module 132 has different connection points for different sources of external power having different voltages and phases. Within the power module 132, for various embodiments, are half- and/or whole-wave rectifiers, step-up and/or step-down transformers, voltage regulators, filter capacitors, and fuses. On the inside of the MSS unit 100, the power module 132 has one or more outlets or sockets providing access to conditioned power. One socket, for example provides 60 hertz single-phase alternating current at 120 volts for common electric appliances. Another socket provides direct current at 5 volts to power phones, tablets, computers, GPS receivers, and other electronic devices. When the MSS unit 100 operates as a medical bay, the power module 132 provides the power needed for specialized medical equipment.

For some embodiments, electrical wiring runs through one or more wall panels. This gives occupants of an MSS unit access to electricity at a wall panel other than the wall panel 112 in which the power module 132 is located. For example, wiring in the wall panel 112 terminates with electric contact terminals at an opening into which the power module 132 is placed. Electric contact terminals on the power module 132 come into electrical contact with the contact terminals in the opening when the power module 132 is seated in the opening.

The wiring in the wall panel 112 also terminates in electric contacts placed on the joint profile 148 of the wall panel 112. When the wall panel 112 is erected against the wall panel 110, the electric contacts placed on the joint profile 148 of the wall panel 112 make contact with electric contacts placed on the joint profile 148 of the wall panel 110. This allows electric current to flow from the power module 132, through the wiring in the wall panel 112, and into wiring in the wall panel 110. Continuing the wiring to other wall panels, allows electrical outlets to be placed in any combination of wall panels. In a different embodiment, the wiring in any wall panel terminates in an electrical plug on one side of the wall panel and an electrical outlet at the other side of the wall panel. After wall panels are erected, the wiring in adjacent wall panels are plugged together to power electrical outlets in the wall panels.

Figure 10:
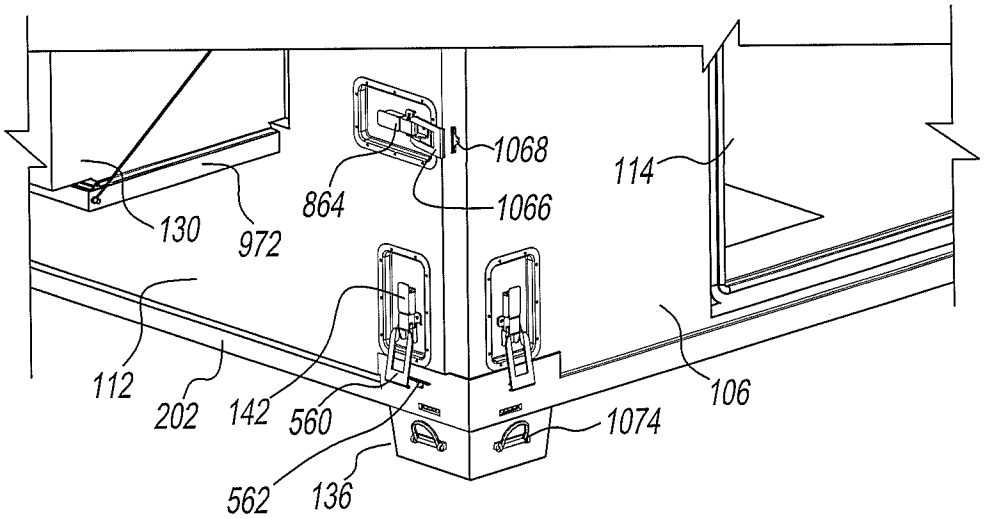
FIG. 10 shows a perspective view of latches securing interconnected panels of an assembled modular unit of a modular shelter system, in accordance with some embodiments.

FIG. 10 provides a more detailed view over FIG. 9 of the lower corner of the MSS unit 100 where the wall panels 106 and 112 meet with the floor panel 202. For the latch 142 on the wall panel 112, the latch arm 560 and the latch anchor 562 on the floor panel 202 are visible. Similarly, for the latch 864 on the wall panel 112, FIG. 10 shows a latch arm 1066 and a latch anchor 1068 on the left lateral end of the adjacent wall panel 106. FIG. 10 also shows the doorway 114 in the wall panel 106 and the HVAC unit 130 on its supporting shelf 972 attached to the wall panel 112.

FIG. 10 additionally shows a tie-down ring 1074 anchored to each of the outside faces of the support block 136. For one embodiment, the tie-down ring 1074 is a pivoting D-ring, as shown. In other embodiments, the tie-down ring is any fixed or moving structure anchored to the support block 136 to which a cable, rope, line, band, strap, cord, or equivalent thereof can be attached for the purpose of lashing the floor 202 and ceiling 904 panels together. In one example, lines tie the tie-down rings 1074 to stakes placed in the ground, or other structures, to keep the MSS unit 100 in place during high winds. In another example, the tie-down rings 1074 are used to secure MSS panels for transport, as is described infra with respect to FIGS. 23 and 24. For a number of embodiments, the tie-down rings 1074 are absent from some or all of the support blocks 136.

Figure 11:
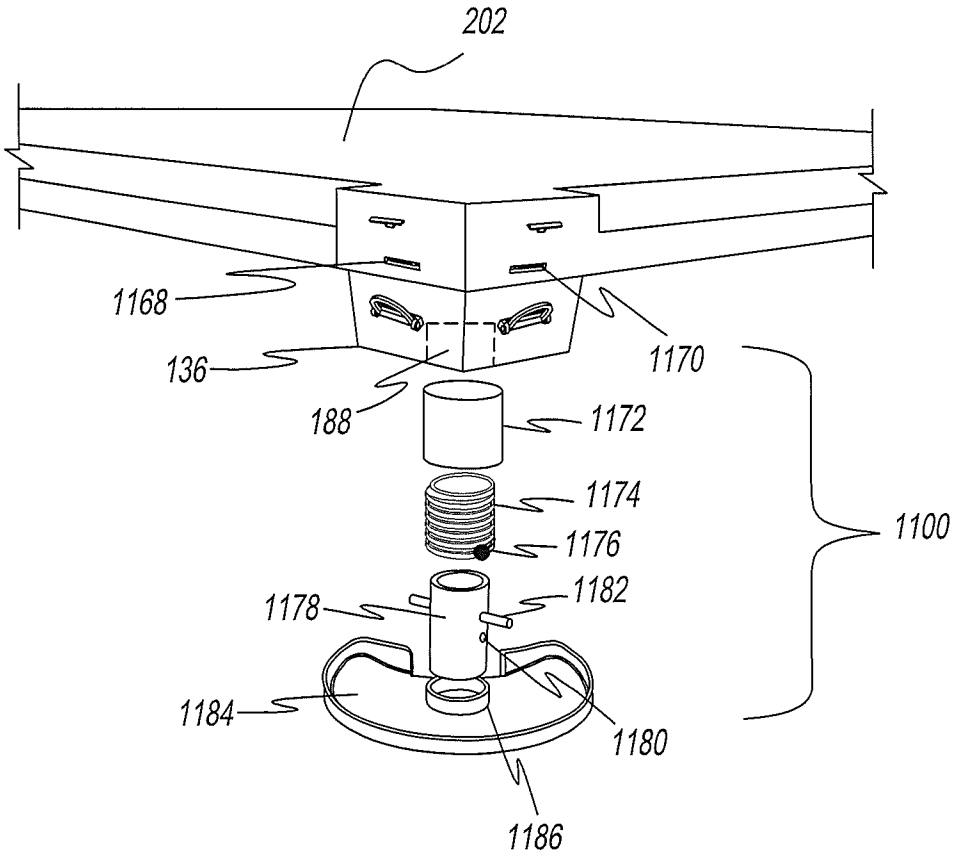
FIG. 11 shows an exploded view of a leveling jack of a modular shelter system, in accordance with some embodiments.

FIG. 11 shows an exploded view of one of four jacks 1100 used to level the floor panel 202 when erecting the MSS unit 100 on uneven terrain. When needed, the leveling of the floor panel 202 using the jacks 1100 occurs prior to erecting the first wall panel 108, which is shown in FIG. 2. For the embodiment pictured, the parts of the jack 1100 include: a threaded insert 1172, a fine adjustment screw 1174, a fine adjustment screw notch 1176, a height adjustment tube 1178 with pin holes 1180, a set pin 1182, and a baseplate 1184 with a retention ring 1186.

The threaded insert 1172 has an outer diameter that allows it to be partially or fully inserted into the recess 188, shown by dashed lines, of the support block 136. The inside of the threaded insert 1172 is threaded, allowing for the fine adjustment screw 1174 to be screwed into the bottom of the threaded insert 1172. An inside diameter of the fine adjustment screw 1174 allows the screw 1174 to slide over the height adjustment tube 1178. The fine adjustment screw 1174 will slide down the height adjustment tube 1178 until the screw 1174 is stopped by the set pin 1182 protruding from a pin hole 1180 of the tube 1178. The bottom of the height adjustment tube 1178 slips over the retention ring 1186 on the top of the baseplate 1184. The retention ring 1186 allows the height adjustment tube 1178 to rotate while the baseplate 1184 remains in place.

To shorten the jack 1100, and thereby lower the corner of the floor panel 202 above the jack 1100, the assemblers remove the set pin 1182 from the upper pin hole (where it is shown) an insert it into the lower pin hole 1180. This allows the fine adjustment screw 1174 to slide further down the height adjustment tube 1178 before being stopped by the set pin 1182. To make fine adjustments to raise or lower the support block 136 above the jack 1100 by a distance of less than the vertical distance between the pin holes 1180 in the height adjustment tube 1178, the assemblers rotate the set pin 1182 until the set pin engages the fine adjustment screw notch 1176. Further turning of the set pin 1182 threads the fine adjustment screw 1174 further in or further out, depending on the turning direction, thereby shortening or lengthening the jack 1100, respectively.

For a number of embodiments, some or all of the jack 1100 parts 1172, 1174, 1178, 1182, 1184 are made by injection molding thermoset or thermoplastic resins. In some embodiments, the threading occurs on metal inserts and metal overlays on otherwise plastic parts. Metal-on-metal contact of the moving threads of the threaded insert 1172 and the fine adjustment screw 1174, for example, increases durability by reducing wear. For a particular embodiment, the set pin 1182 is metal for strength.

For several embodiments, the threaded inserts 1172 are fixed in some or all of the recesses 188 of the support blocks 136. In one embodiment, the outside surfaces of the threaded inserts 1172 are bonded in the recesses 188 using an adhesive. For another embodiment, the threaded inserts 1172 are press fit (i.e., interference fit or shrink fit) into the recesses 188 of the support blocks 136. In further embodiments, an outer diameter of the height adjustment tubes 1178 is smaller than the inner diameter of the threaded inserts 1172 so the height adjustment tubes 1178 can be inserted into the threaded inserts 1172 when the threaded inserts 1172 are fixed in the recesses 188 of the support blocks 136.

Shown on the outside faces of the support block 136 are two bubble levels 1168 and 1170, which provide an indication of how level the floor panel 202 is in two different directions. In adjusting the height of the jack 1100, the assemblers reference the bubble levels 1168, 1170 to determine whether the support block 136 above the jack should be raised or lowered. In some embodiments, the bubble levels 1168, 1170 are replaced by other instruments, either analog or digital, indicating levelness, such as a transparent capsule filled with fluid and having a horizontal reference line. For one embodiment, the support block has a vertical reference line indicated thereon with an accompanying protrusion from which to hang a plumb bob. In another embodiment, no instrument indicating levelness is integrated into the floor panel 202.

By using the jacks 1100 to make the floor panel 202 level, for example, the door 116 of the assembled MSS unit 100 will remain open unless purposefully closed. In another embodiment, the assemblers use the jacks 1100 to slightly elevate the side of the floor panel 202 over which the door 116 will be located so the door 116 of the assembled MSS unit 100 will gently swing closed under the influence of gravity after being opened. For a different embodiment, a spring, hydraulic cylinder, or other mechanical device automatically closes the door 166 after it is opened. This document incorporates by reference all of the material in U.S. Patent Application Publication No. 2002/0145136 published on Oct. 10, 2002 and entitled "Jack Assembly for Supporting a Shelter Structure."

Figure 12:
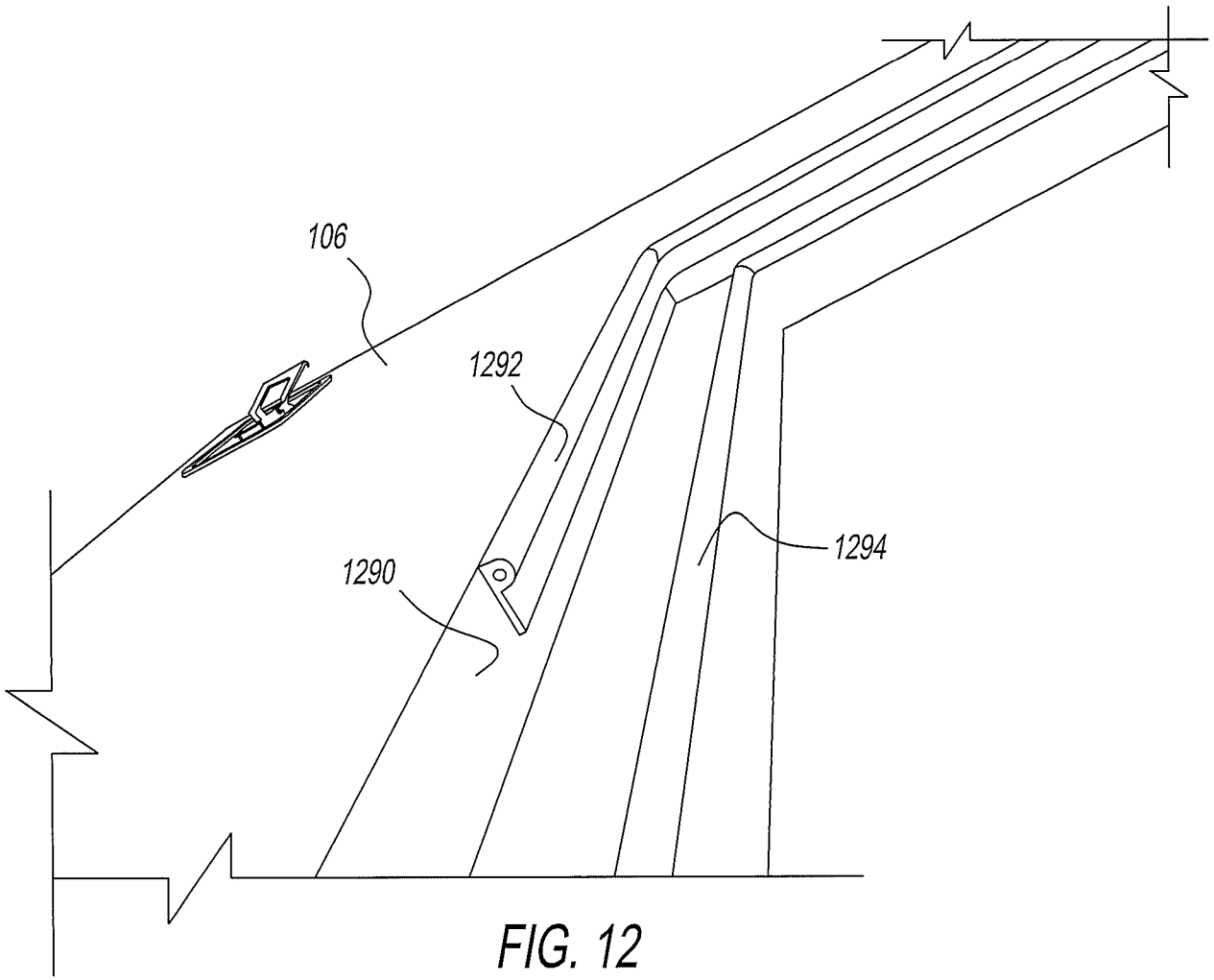
FIG. 12 shows a perspective view of a door frame in an interchangeable wall panel of a modular shelter system, in accordance with some embodiments.

FIG. 12 shows a door frame profile 1290 of the doorway 114 in the wall panel 106 with which a matching door edge profile 916 mates when the door 116 is closed. As shown, the door frame profile 1290 is tiered so there are multiple surfaces with which the door edge profile 916 comes into contact. On a laterally facing outermost surface of the door frame profile 1290 is a gasket 1292 that engages an opposing laterally facing outermost surface of the door edge profile 916. Additionally, on an outward-facing surface of the door frame profile 1290 is a gasket 1294 that engages either the back side of the door 116 or an inward-facing surface of the door edge profile 916. Where the door 116 thickness approximately matches the thickness of the wall panel 106, a laterally facing innermost surface of the door edge profile 916 mates with an opposing laterally facing innermost surface of the door frame profile 1290.

For some embodiments, the gaskets 1292 and 1294 create an airtight and/or watertight seal between the door 116 and the door frame of the wall panel 106. This is similar to the seal created by the seal 452 between the wall panel 106 and the floor panel 202. As with the seal 452, the gaskets 1292, 1294, or other door sealing mechanism, are made from different materials to have different contours in different embodiments. Further, the number of gaskets used and the number of mating surfaces between the door frame profile 1290 and the door edge profile 916 varies in different embodiments.

Figure 13:
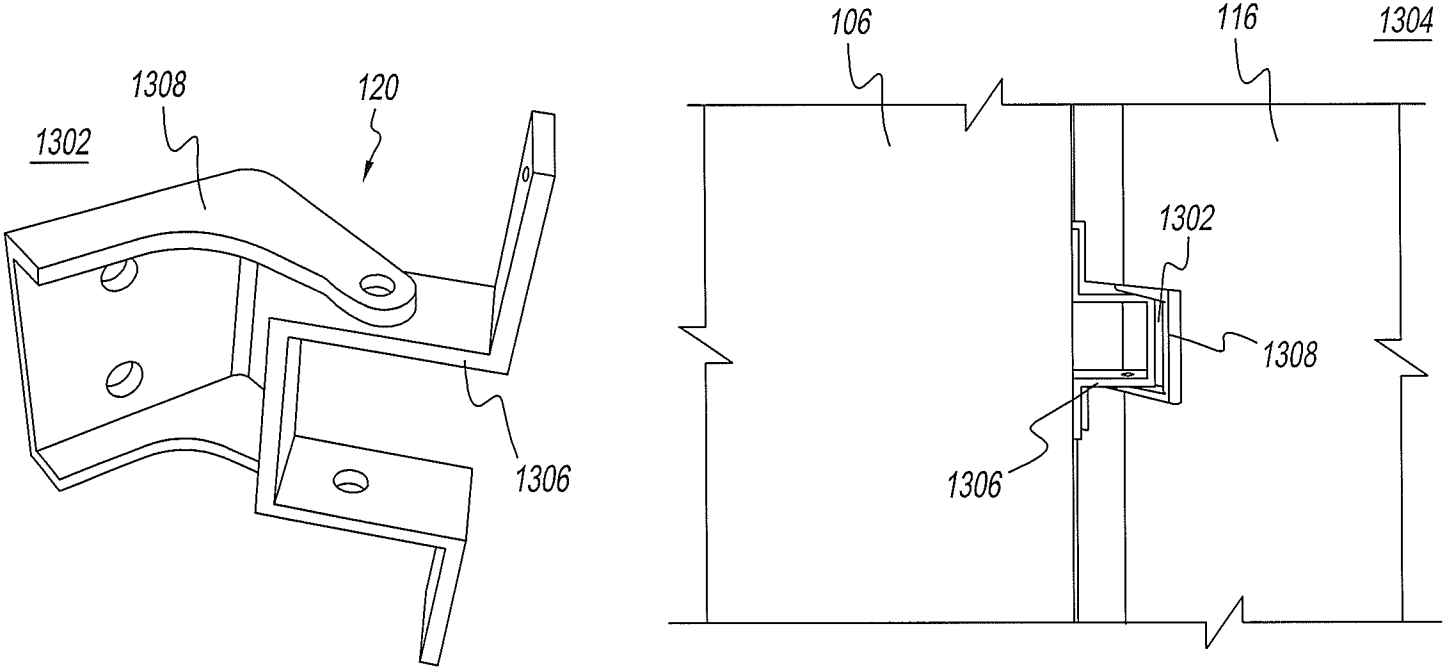
FIG. 13 shows an isolated view and an integrated view of a door hinge, in accordance with some embodiments.

FIG. 13 shows two views of the hinge 120 used to pivotally mount the door 116 to the door frame of the wall panel 106. The hinge 120 is pictured in isolation in a view 1302 and is pictured in operation in a view 1304. View 1302 shows the hinge 120 having two parts, namely, a hinge base 1306 and a pivotally connected hinge arm 1308. View 1304 shows the hinge base 1306 secured to the door frame of the wall panel 106 and the hinge arm 1308 secured to an inside lateral edge of the door 116. The hinge base 1306 is shown to have a standoff height which results in the door 116 being slightly more parallel to the wall 106 panel, as compared to the use of more conventional hinges, as the door 116 closes in the doorway 114 to engage the sealing gaskets 1292, 1294. This allows for a better seal. To accommodate the standoff height of the hinge frame 1306 when the door 116 is closed, a hinge notch 1302 is created in the door edge to clear the hinge frame 1306.

In different embodiments, different hinges, or different mechanisms operating as hinges, connect the door 116 to the door frame of the wall panel 106 and allow for the door 116 to be opened and closed. For one embodiment, a single hinge is used which is approximately the same length as the height of the door 116. In other embodiments, different numbers and/or different combinations of hinges or pins are used to pivotally connect the door 116 to the door frame of the wall panel 106.

Figure 14:
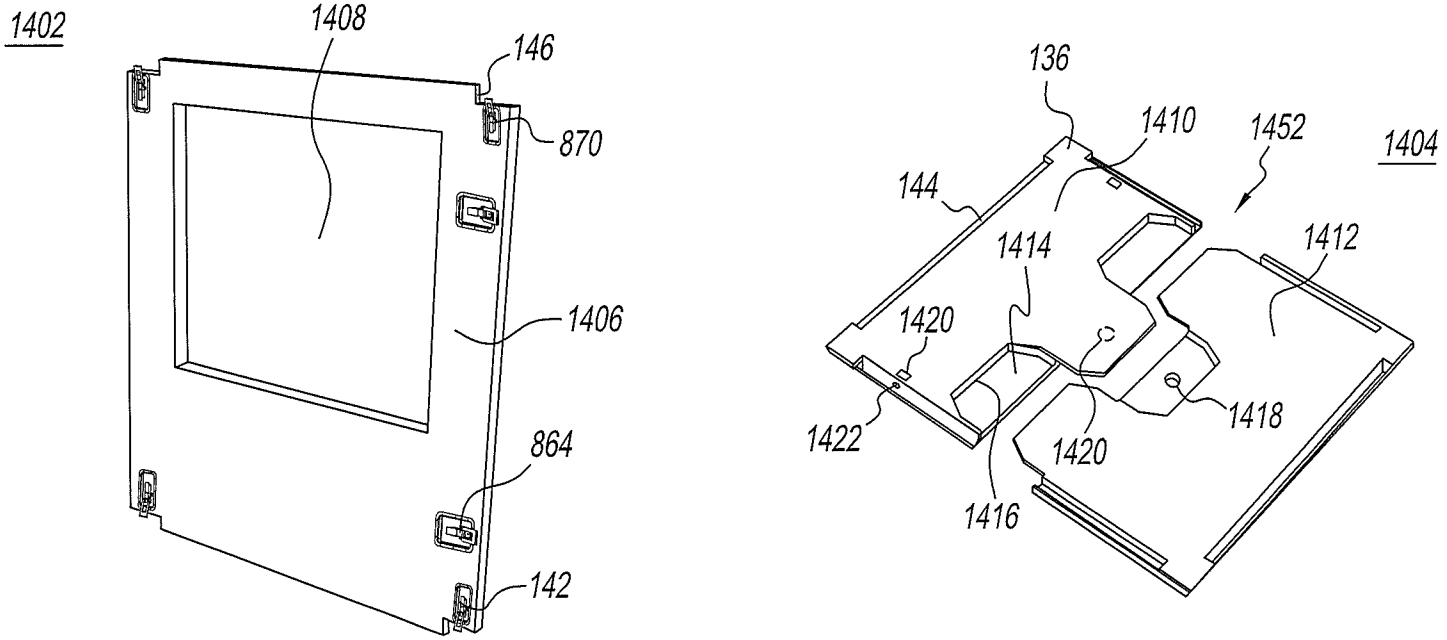
FIG. 14 shows perspective views of a windowed wall panel and a separable floor panel, in accordance with some embodiments.

FIG. 14 provides examples of two interchangeable panels not pictured in earlier figures. A view 1402 shows a wall panel 1406 having a window 1408. For some embodiments, the window 1408 is an open space in the wall panel 1406. In other embodiments, the window 1408 represents a transparent barrier. For a particular embodiment, the transparent barrier for the window 1408 is made from a ballistic-resistant material, such as a laminated polycarbonate sheet. The latches 142, 864, 870 and the interconnection tongues 146 of the wall panel 1406 make the panel 1406 interchangeable with other wall panels, such as the wall panels 106, 108, 110, and 112.

View 1404 shows an interchangeable floor panel 1452, which is separable into a first section 1410 and a second section 1412. When the two sections 1410, 1412 of the floor panel 1452 are joined, the support block 136 at each corner of the floor panel 1452 and the interconnection grooves 144 between the support blocks 136 along the edges of the floor panel 1452 make the panel 1452 interchangeable with other floor panels, such as the floor panels 102 and 202.

On the mating edges of the two floor panel sections 1410, 1412 is a floor panel edge profile 1416 that provides one or more overlapping surfaces when the sections 1410, 1412 are joined. For some embodiments, there is sealing material on one or more of the one or more overlapping surfaces of the joint profile 1416 to create an airtight and/or watertight seal. In other embodiments, the floor panel sections 1410, 1412 fit tightly enough together so that a sealing material is not used between the panel sections 1410, 1412.

For the embodiment shown, a lower connection hole 1418 passes through the floor panel section 1412 and lines up with an upper connection hole 1420 on an overlapping portion of the floor panel section 1410. When the two floor panel sections 1410, 1412 are joined, a connection pin is pushed through the lower connection hole 1418 and into the upper connection hole 1420 to hold the floor panel sections 1410, 1412 together. The connection pin, for example, can have a ball and detent or other retention mechanism by which the pin holds firm in the lower 1418 and upper 1420 connection holes until purposefully removed.

Because the upper connection hole 1420 does not pass completely through the overlapping portion of the floor panel section 1410, as indicated by the dashed line, the connection hole 1420 does not allow gas or liquid to enter an MSS unit assembled with the floor panel 1452. For some embodiments, the upper connection hole 1420 is large enough to accommodate the threaded insert 1172 with enough structural integrity so the jack 1100 can be used under the upper connection hole 1420 to level the floor panel section 1410 when the panel section 1410 is used without the panel section 1412. The floor panel section 1410 is leveled, for example, with a jack 1100 placed under each of the recesses 188 in the two support blocks 136 of the panel section 1410 and a jack 1100 placed under the upper connection hole 1420.

The floor panel section 1410 is also shown to have two support bracket pockets 1420, each with a retaining pin hole 1422. The function of the support bracket pockets 1420 and the retaining pin holes 1422 is described with reference to FIG. 15.

Figure 15:
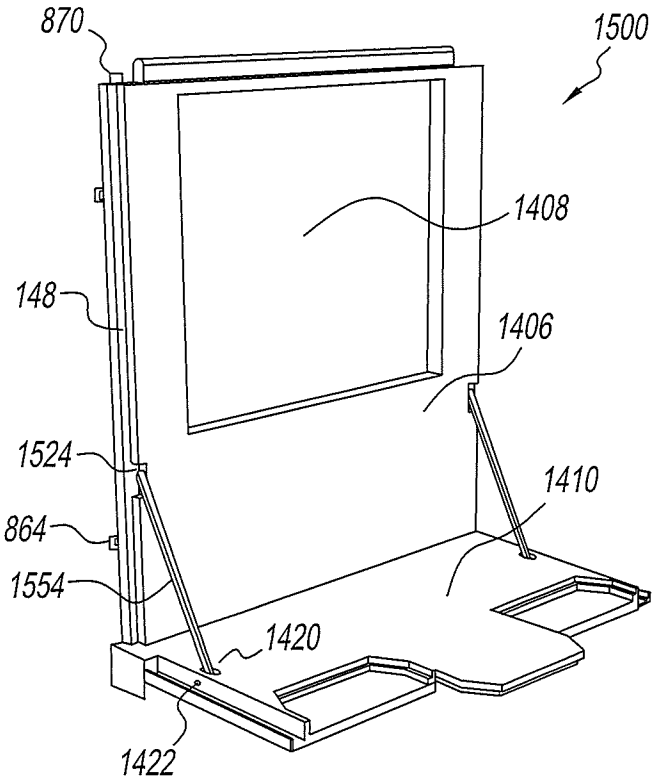
FIG. 15 shows a perspective view of a windowed wall panel interconnected with a section of a separable floor panel, in accordance with some embodiments.

FIG. 15 shows the windowed wall panel 1406 interconnected with the first floor panel section 1410. Together, these two pieces 1406, 1410 form a two-panel fighting position 1500. Without the support from additional wall panels, support brackets 1554 are used to stabilize the fighting position 1500. As shown, the lower end of the support bracket 1554 is placed in the support bracket pocket 1420, where the support bracket 1554 is held in place by a retaining pin that passes through the support bracket 1554 via the retaining pin hole 1422 accessible from the side edge of the floor panel section 1410. The upper end of the support bracket 1554 is placed in a support bracket notch 1524 on the side edge of the wall panel 1406, where the support bracket 1554 is held in place with another retaining pin. The fighting position 1500 can be leveled over uneven terrain with the use of three jacks 1100 as described supra with respect to FIG. 14.

In various embodiments, the height of the lower end of the window 1408 opening is between one and four feet, allowing a soldier to fire from a prone or kneeling position with the wall panel 1406 providing cover. In additional embodiments, the distance between the side of the window 1408 opening and the side edge of the wall panel 1406 is between one and two feet, allowing the soldier to fire from a standing position with the wall panel 1406 providing cover. In other embodiments, the window 1408 opening can have any height or width within the height and width of the wall panel 1406.

Prior to erecting any MSS units, a perimeter can be secured around a shelter assembly site using quickly assembled fighting positions 1500. With the fighting positions 1500 in place and manned, the assemblers can proceed with erecting single and interconnected MSS units. The wall panels 1406 and the floor panel sections 1410 of the fighting positions 1500 can then be integrated into additional MSS units.

Figure 16:
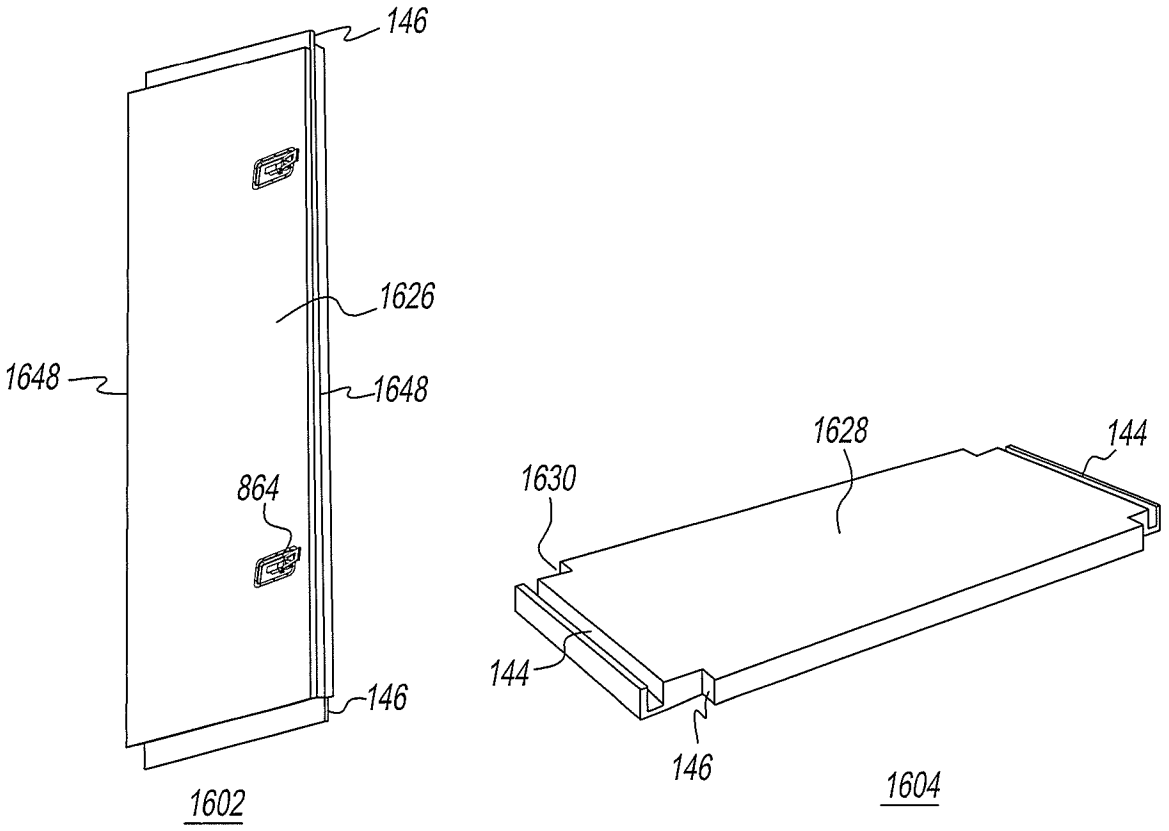
FIG. 16 shows perspective views of a wall interconnection panel and a floor interconnection panel, in accordance with some embodiments.

FIG. 16 illustrates a wall interconnection panel 1626 and a floor/ceiling interconnection panel 1628 used to interconnect different MSS units to make larger MSS units. View 1602 shows the wall interconnection panel 1626 with the interconnection tongue 146 on its top and bottom edges and a joint profile 1648 on each of its lateral sides. View 1604 shows the floor/ceiling interconnection panel 1628 with the interconnection groove 144 on each of its two outside ends and the interconnection tongue 146 on each of its inside ends. The interconnection grooves 144 and the interconnection tongues 146 of the floor/ceiling interconnection panel 1628 terminate at a support block notch 1630 in each of the four corners of the interconnection panel 1628.

The interconnection tongues 146 at the top and bottom of the wall interconnection panel 1626 fit into the interconnection grooves 144 of one interconnection panel 1628, used as a ceiling interconnection panel, and another interconnection panel 1628, used as a floor interconnection panel, respectively. The interconnection tongues 146 of another wall interconnection panel 1626 fit into the interconnection grooves 144 on the other sides of the floor/ceiling interconnection panels 1628. The four interconnected interconnection panels 1626, 1628 form an interconnection collar, with the latches 864 on the wall interconnection panels 1626 facing outward. This interconnection collar replaces a wall panel of the MSS unit 100 as pictured in FIG. 17.

Figure 17:
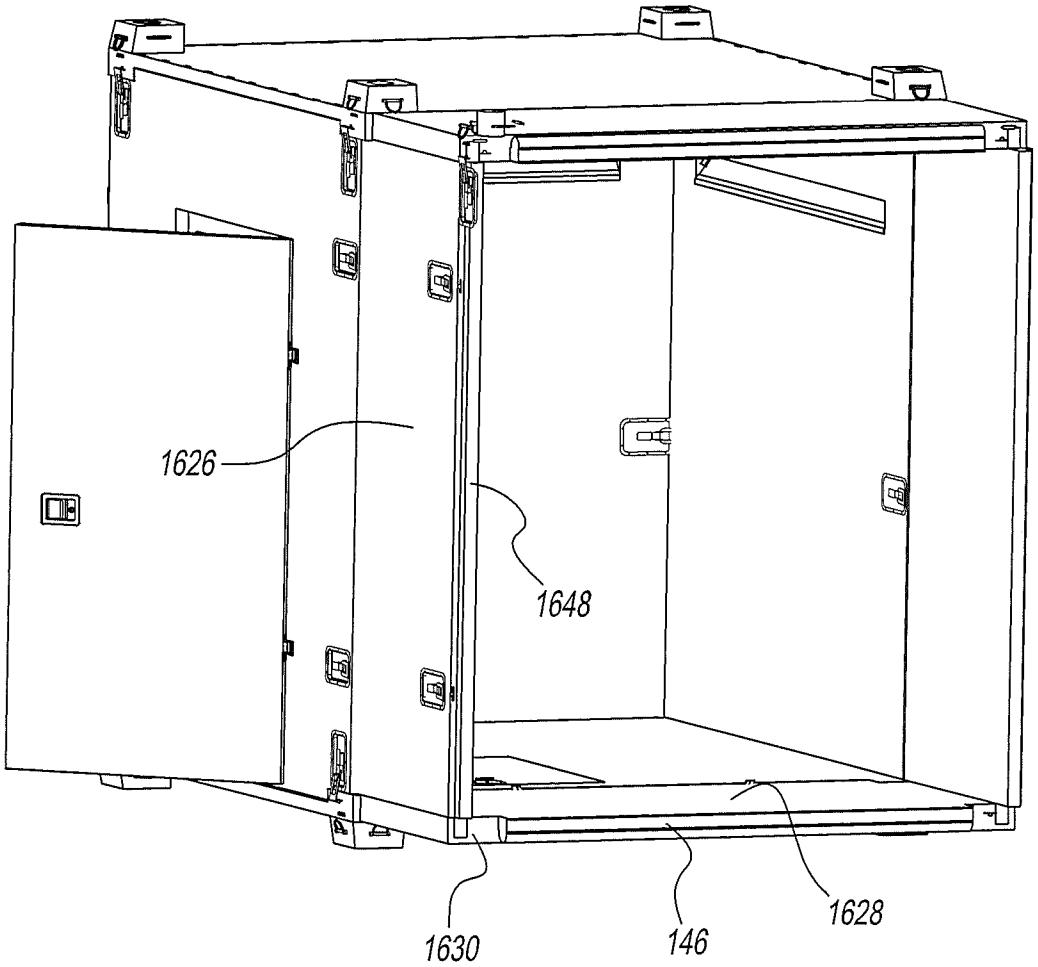
FIG. 17 shows a perspective view of an interconnection collar connected to an assembled modular unit of a modular shelter system, in accordance with some embodiments.

FIG. 17 shows one side of the interconnection collar taking the place of the wall panel 108 of the MSS unit 100. This creates in a walkway from the interior of the MSS unit 100, through the interconnection collar, and into another MSS unit to which the other side of the interconnection collar is connected. As illustrated, the support block notches 1630 in each of the four corners of the interconnection panels 1628, used as floor and ceiling interconnection panels, provide clearance for the support blocks 136 on the side of the MSS unit 100 to which the interconnection collar is connected.

Figure 18:
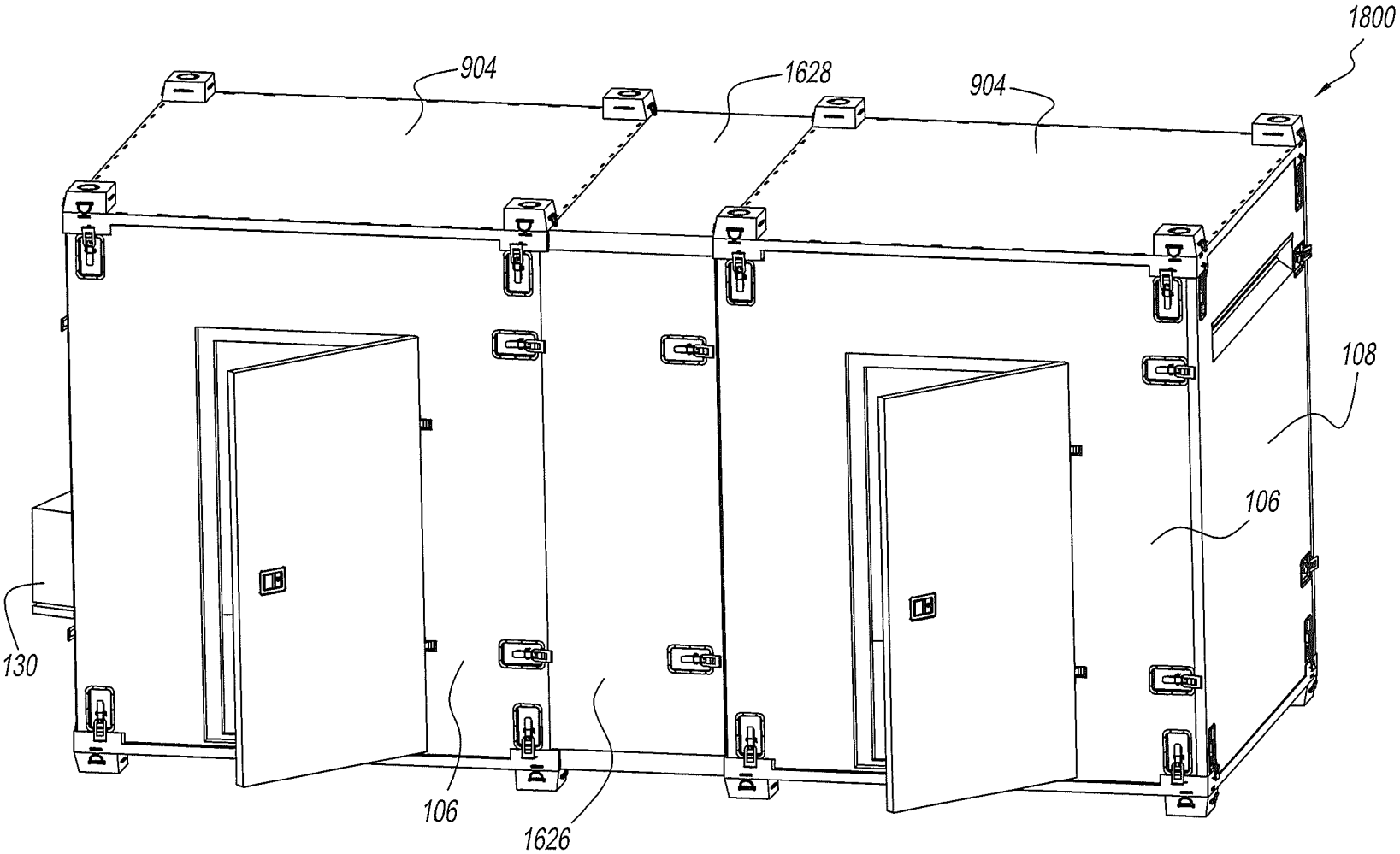
FIG. 18 shows a perspective view of an interconnection collar laterally interconnecting two modular units of a modular shelter system, in accordance with some embodiments.

FIG. 18 shows the interconnection collar interconnecting two MSS units in a side-by-side arrangement to form a double MSS unit 1800. If two doors are not needed, either of the wall panels 106 can be replaced with an interchangeable wall panel having a different configuration. To chain three MSS units together in a line, the wall panel 108 of the double MSS unit 1800 can be replaced with another interconnection collar connected to a third MSS unit. This process can continue to laterally interconnect any number MSS units. Using the interconnection panels 1626, 1628, MSS units can also be interconnected in an "L" configuration. This is pictured in FIG. 19.

Figure 19:
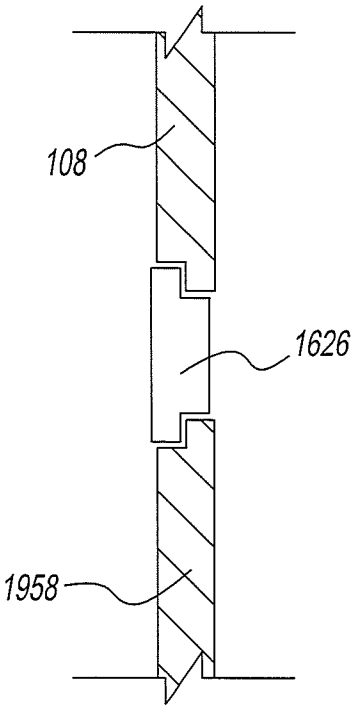
FIG. 19 shows a top-down cross-sectional view of interchangeable wall panels joined by wall interconnection panels, in accordance with some embodiments.
Figure 19:
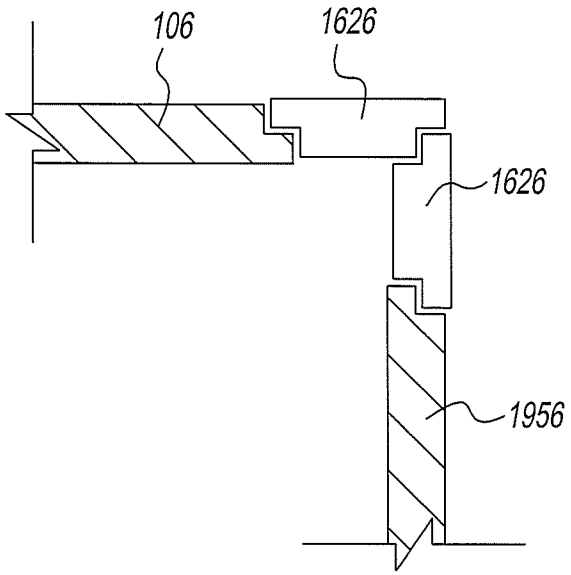

FIG. 19 shows a top-down cross-sectional view of the wall panels on the front side of the double MSS unit 1800. A wall interconnection panel 1626 replaces the right side of the right wall panel 106 to linearly interconnect the wall panel 108 with a wall panel 1958 of arbitrary configuration. Two wall interconnection panels 1626 joined together at a right angle replace the left side of the right wall panel 106 to orthogonally interconnect the left wall panel 106 with a wall panel 1956 of arbitrary configuration. At the bottom of each wall interconnection panel 1626 is an interconnection tongue 146 fitted into an interconnection groove 144 of a floor interconnection panel 1628. In this way, multiple MSS units can be interconnected in an "L" configuration. By intermittently corner connecting MSS units, a plurality of MSS units can be chained together to close on themselves, forming a perimeter around an area resembling a courtyard.

As described for some or all of the joint profiles 148 of the wall panels and the interconnection groves 144 of the floor and ceiling panels, some or all of the joint profiles 1648 of the wall interconnection panels 1626 and the interconnection groves 144 of the floor/ceiling interconnection panels 1628 have on or within them a sealing material to create airtight and/or watertight seals at interconnection interfaces when the wall interconnection panels 1626 and the floor/ceiling interconnection panels 1628 are assembled into an extended MSS unit. A wall interconnection panel 1626, for example, seals with another wall interconnection panel 1626 on one side and a wall panel on the other side, as shown on the left side of FIG. 19, or between two wall panels, as shown on the right side of FIG. 19.

Figure 20:
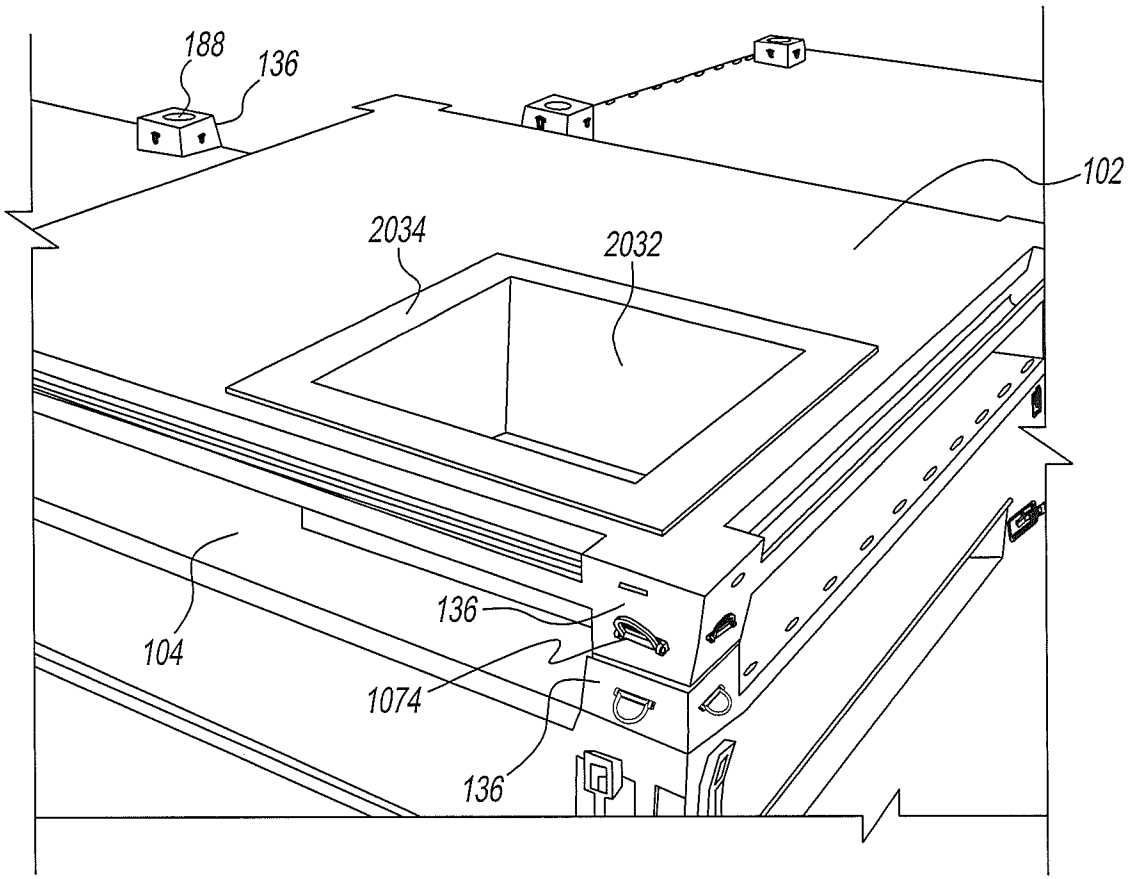
FIG. 20 shows a perspective view of an interconnection sleeve between stacked modular units of a modular shelter system, in accordance with some embodiments.

In addition to laterally interconnecting MSS units in different directions, MSS units can also be stacked. FIG. 20 shows an intermediate stage of an MSS unit being assembled on top of another MSS unit in a chain of laterally interconnected MSS units. The MSS unit 100 having the ceiling panel 104 is pictured on a lower level. On top of the ceiling panel 104 is the floor panel 102, which is the ceiling panel 104 flipped over.

With the MSS unit 100 assembled, the assemblers place one end of a jack height adjustment tube 1178 in the recess 188 of each of the support blocks 136 on the upper side of the ceiling panel 104. The height adjustment tubes 1178 are long enough so an upper portion of the tubes 1178 extend out from the recesses 188. When the assemblers place the floor panel 102 on top of the ceiling panel 104, the upper portions of the height adjustment tubes 1178 insert into the downward-facing recesses 188 in the support blocks 136 of the floor panel 102. Then, the assemblers erect and secure the wall panels on top of the floor panel 102 as previously described for the MSS unit 100.

The upper MSS unit can also be assembled on the ground, hoisted up over the top of the lower MSS unit 100, and then lowered onto the height adjustment tubes 1178 extending up from the support blocks 136 of the ceiling panel 104. The upper MSS unit can also be hoisted up and lowered, for instance, by using a block-and-tackle rigging with the tie-down rings 1074, a fork lift, a crane, or other lifting and lowering mechanism.

With the floor panel 102 of the upper MSS unit positioned over the ceiling panel 104 of the lower MSS unit 100, the hatchways 134 of the floor 102 and ceiling 104 panels are aligned one over the other, respectively. FIG. 20 shows an interconnection sleeve 2032 connected between the hatchways 134. The interconnection sleeve 2032 isolates the space between the two hatchways 134 from the outside environment and makes it part of the inside volume of the stacked MSS units. The interconnection sleeve 2032 also allows for occupants to move between the lower 100 and upper MSS units without hitting or getting clothing caught up on any edges of the hatchways 134, as well as providing concealment of movement.

As shown, the interconnection sleeve 2032 has a collar 2034 on each end to secure the sleeve 2032 to the downward-facing surface of the ceiling panel 104 and to the upward-facing surface of the floor panel 102. In one embodiment, the interconnection sleeve 2032 is made from a weather-resistant or weatherproof fabric. For some embodiments, the interconnection sleeve 2032 is a single piece of molded material. In further embodiments, the interconnection sleeve 2032 is flexible so it can be deformed to get a collar 2034 on one end of the sleeve 2032 through a hatchway 134. The pictured interconnection sleeve 2032, for instance, is deformed and one end is fed through both hatchways 134 from the lower MSS unit 100 to the upper MSS unit. The interconnection sleeve 2032 is then allowed to reacquire its natural shape so that the upper collar 2034 of the sleeve 2032 seals with the upper surface of the floor panel 102 around the hatchway 134, as shown, and the lower collar 2034 of the sleeve 2032 seals with the lower surface of the ceiling panel 104 around the hatchway 134.

In a particular embodiment, the interconnection sleeve collar 2034 is stiffer than the body of the sleeve 2032. For example, the sleeve collar 2034 is made from a different material than an elastic material from which the body of the sleeve 2032 is made. The stretched elastic material of the sleeve body pulls the sleeve collars 2034 tight against their intended surfaces to form seals, which in some instances are airtight and/or watertight. Because the sleeve collars 2034 are relatively stiff, the pulling force is insufficient to pull either collar 2034 of the interconnection sleeve 2032 through a hatchway 134.

In a number of embodiments, the undersides of the sleeve collars 2034 have one or more protrusions or recessions which fit or lock into matching recessions or protrusions, respectively, in the surfaces over which the collars 2034 are placed. In a first example, a circumferential protrusion is elastic and deformable to facilitate the interconnection sleeve 2032 sealing out the outside environment from the inside of stacked MSS units. In a second example, protrusions are rigid to help hold the collars 2034 in place. In a third example, the collars 2034 are stretched over lips surrounding the hatchways 134 on the floor 102 and ceiling 104 panels. In a fourth example, a combination of elastic and rigid protrusions is used in securing the collars 2034 of the interconnection sleeve 2032 in place. For an additional embodiment, a sealing tape is applied around the edge of each sleeve collar 2034 to seal the collars 2034 over their mated surfaces.

Figure 21:
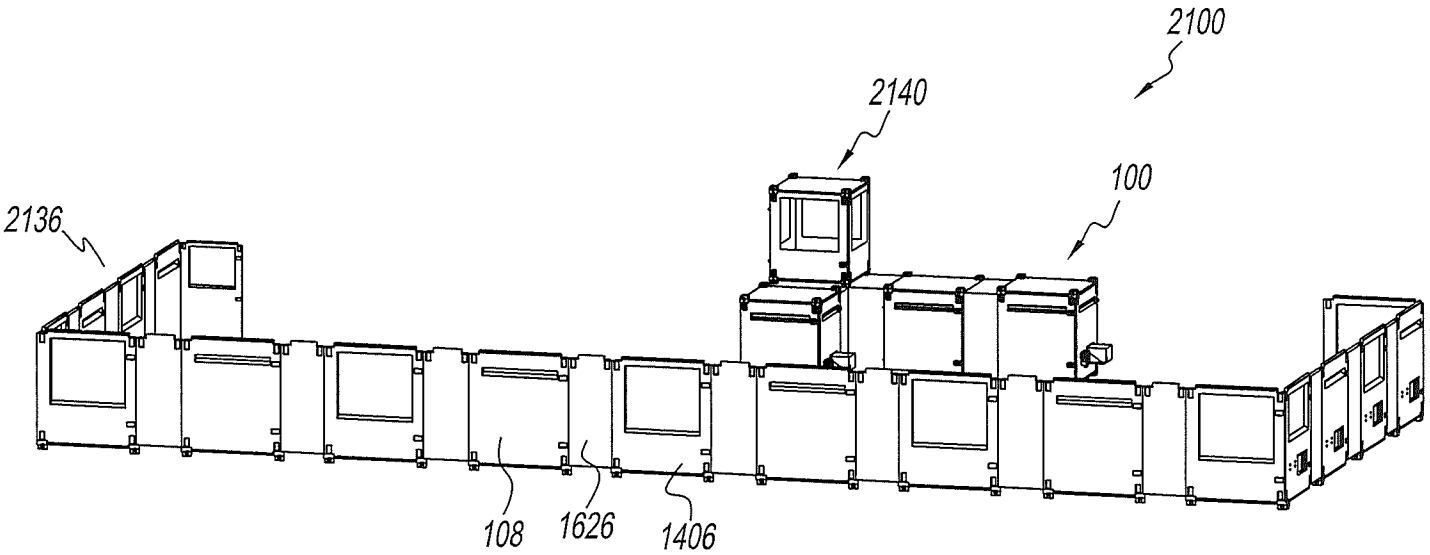
FIG. 21 shows interconnected units and components of a modular shelter system forming a shelter complex, in accordance with some embodiments.

FIG. 21 shows an assembled shelter complex 2100 arranged from stacked and laterally interconnected MSS units and components. Pictured within a complex perimeter 2136 of interconnected wall panels, is the MSS unit 100. Laterally interconnected with the MSS unit 100 are three additional MSS units arranged in an "L" pattern. The four laterally interconnected MSS units include a wall panel 112 on each terminal MSS unit providing a pair of HVAC units 130 to service the larger volume of four MSS units over a single MSS unit. The volume of a stacked MSS unit 2140 is isolated from the enclosed volume of the four laterally interconnected units by closing the hatchway 134 of the ceiling panel 104 of the MSS unit below the stacked MSS unit 2140 with the hatch cover 138.

The stacked MSS unit 2140 is shown configured as an observation post. The unit's raised elevation and four windowed wall panels 1406 provide an unobstructed view over the complex perimeter 2136 and make it an ideal lookout position. When needed, the windowed wall panels 1406 also provide a covered firing position, as described supra with reference to FIG. 15. For this reason, the windowed wall panels 1406 are also incorporated into the complex perimeter 2136.

The straight sections of the complex perimeter 2136 are pictured with alternating windowed 1406 and slotted 108 wall panels interconnected by wall interconnection panels 1626. Each corner of the complex perimeter 2136 is formed by two directly interconnected windowed wall panels 1406. For additional stability of the complex perimeter 2136, a number of windowed wall panels 1406 are joined with the first sections 1410 of the separable floor panels 1452 using the support brackets 1554 as shown in FIG. 15. For a number of embodiments, some or all of the slotted wall panels 108 and the wall interconnection panels 1626 of the complex perimeter 2136 are interconnected with the floor panels 202 and the floor interconnection panels 1628, respectively.

The pictured shelter complex 2100 is but one arrangement of the modular MSS units and interchangeable components described herein. Additional shelter complexes with different layouts are realized simply by assembling the modular MSS units and interchangeable components as needed. Further, any assembled shelter complex can be expanded or reduced with the arrival or departure of personnel by adding or removing, respectfully, modular MSS units and interchangeable components.

Figure 22:
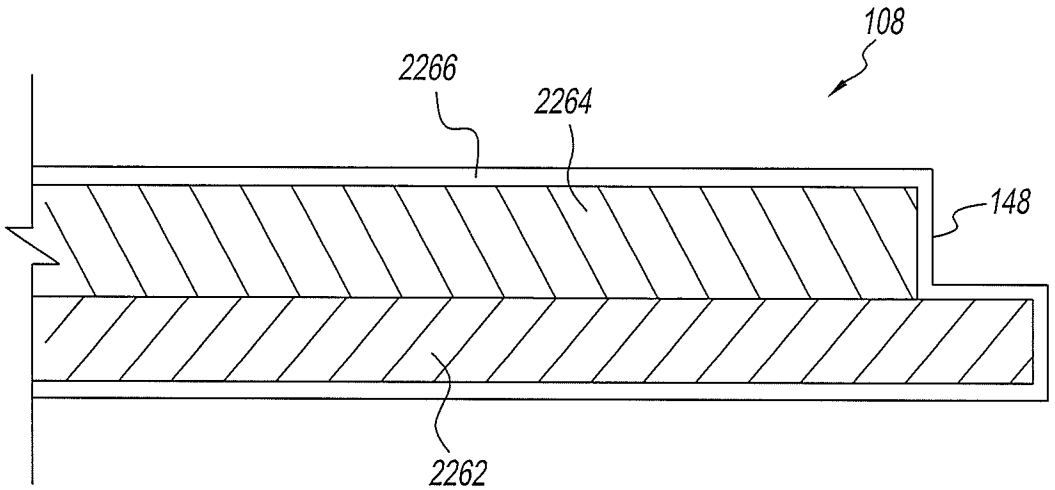
FIG. 22 shows a top-down cross-sectional view of an interchangeable wall panel illustrating laminations within the wall panel, in accordance with some embodiments.

FIG. 22 shows a top-down cross-sectional view of a wall panel having a laminated construction. As shown, two material sheets 2262 and 2264 are placed back-to-back and surrounded or encapsulated by a unifying and/or protective shell 2266. In various embodiments, different numbers of material sheets can be used, with different sheets having different materials for different purposes. The material sheet 2264, for example, is made of a thermally insulating material, such as fiberglass or closed-cell foam, to keep occupants of the MSS unit 100 comfortable. The material sheet 2262 is made from a ballistic-resistant material to shield the occupants of the MSS unit 100 from shrapnel and projectiles. The outer shell 2266 for an embodiment is a thermoset or thermoplastic resin molded around the material sheets 2262, 2264 to hold the sheets 2262, 2264 together and create a unified panel.

In a number of embodiments, floor and ceiling panels are also made from stacked material sheets. In some instances, the floor and ceiling panels will use different materials or different proportions of the same materials. A floor panel might have less ballistic protection than a wall panel, for example, but have a thicker structurally supporting lamination to hold the weight of shelter occupants in addition to the weight of the ceiling and wall panels.

For additional embodiments, separate external sheets having different material properties can be attached to the outsides of the wall panels. For additional ballistic protection, for instance, a metal, ceramic, advanced fiber composite sheet, or a combination of all three, might be hung over a wall panel using hooks, or other attachment means, connected to the top or side of the wall panel.

Figure 23:
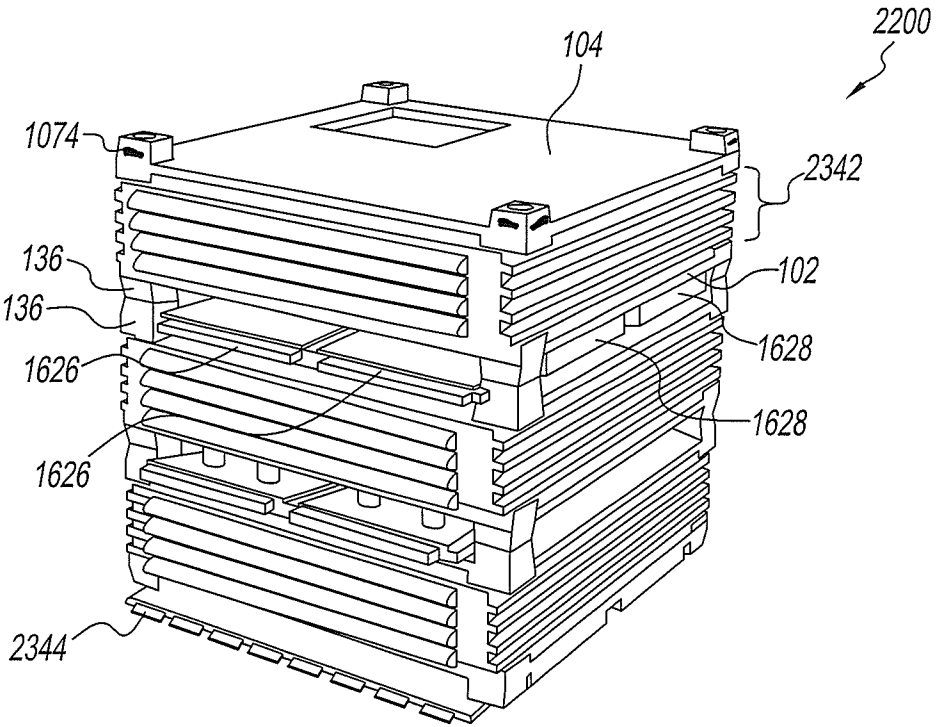
FIG. 23 shows a perspective view of the packaging for transport of components of a modular shelter system, in accordance with some embodiments.

FIG. 23 shows the packaging of interchangeable MSS components for transport and shipping. A pictured package 2200 bundles enough floor, ceiling, wall, and interconnection panels to assemble three interconnected MSS units. For the embodiment shown, these packaged components are sized to fit on and ship with a standardized 463L Master Pallet 2344 used for transporting military air cargo. In other embodiments, the interchangeable MSS components are of a size and weight to be shipped using pallets and/or containers having different sizes.

At the top of the package 2200 is shown a ceiling panel 104 with the recesses 188 in its support blocks 136 facing upward. Under the ceiling panel 104 are four wall panels 2342, stacked one atop another. For some embodiments, the wall panels 2342 have one or more protrusions or recesses on either side that mate with the recesses or protrusions, respectively, on the next wall panel. This allows the wall panels 2342 to interlock when stacked as part of the package 2200 for transport and shipping.

Below the wall panel stack 2342 is a floor panel 102 with the recesses 188 in its support blocks 136 facing downward. The downward-facing recesses of the floor panel 102 support blocks 136 align with upward-facing recesses in the support blocks 136 of the next-lower ceiling panel in the package 2200. To keep the support blocks 136 of the floor panel in vertical alignment with the support blocks of the ceiling panel underneath, the jack height adjustment tubes 1178 are inserted into the recesses 188 as shown in FIG. 24 and described supra with reference to FIG. 20.

The described stacking is repeated three times to produce the package 2200. In each of the two vertical spaces created between floor and ceiling panels having abutting support blocks 136, are inserted two wall interconnection panels 1626 and two floor/ceiling interconnection panels 1628, enough interconnection panels for two interconnection collars to laterally interconnect three MSS units. The MSS components of the package 2200 can be further secured to one another and the pallet 2344 by using the tie-down rings 1074 on the support blocks 136 with cables, ropes, lines, bands, straps, cords, or equivalent thereof.

Figure 24:
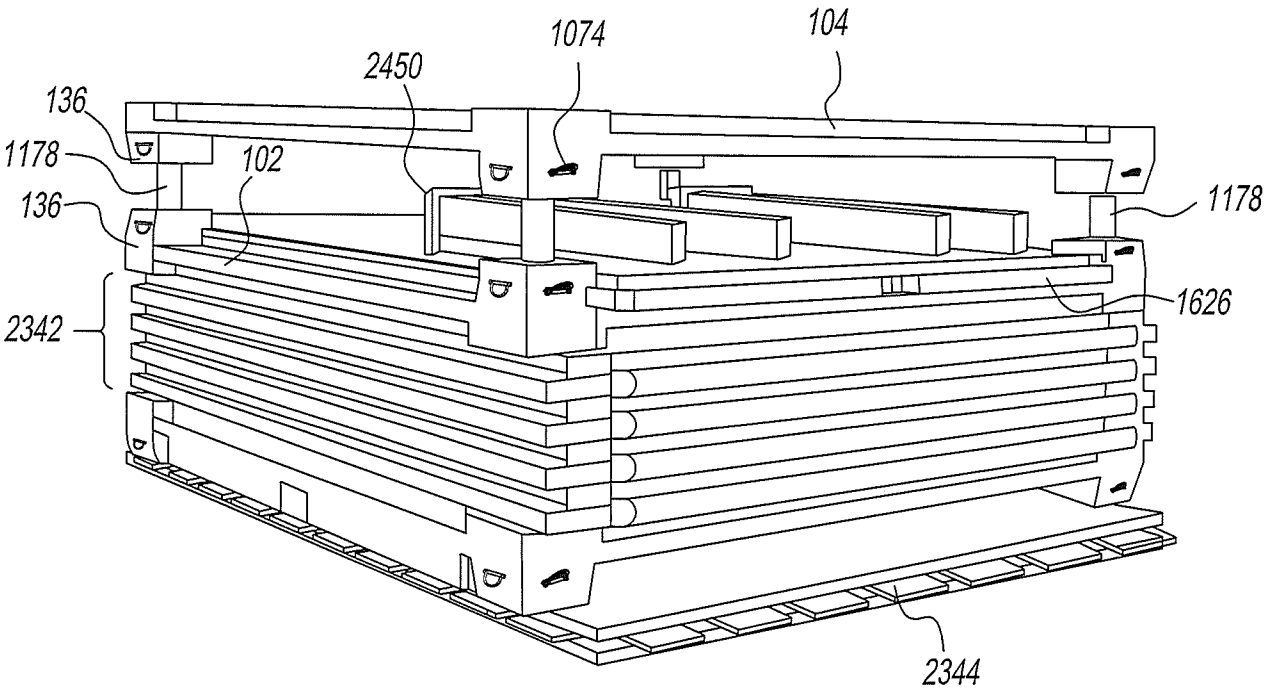
FIG. 24 shows a perspective view of the packaging for transport of components of a modular shelter system, in accordance with some embodiments.

FIG. 24 shows an exploded view of the vertical space created between packaged floor 102 and ceiling panels 104 having abutting support blocks 136. In this exploded view, the jack height adjustment tubes 1178 inserted in the recess 188 of the support blocks 136 are visible. With the components for each pair of MSS units intended for stacking, one fewer sets of interconnection panels 1626, 1628 are needed. In the vertical space pictured in FIG. 24, the two floor/ceiling interconnection panels 1628 shown in FIG. 23 are replaced with ladders 2450 to be used by personnel to assemble and to climb between the levels of stacked MSS units.

In the foregoing specification, specific embodiments have been described. However, one of ordinary skill in the art appreciates that various modifications and changes can be made without departing from the scope of the teachings disclosed herein as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The claimed material defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A method for deploying a modular shelter system, the modular shelter system having interconnecting components including:

a first floor panel comprising:

a first curved surface along a lateral edge on a top side of the first floor panel; and a first inside surface located inside of the first curved surface; and a first wall panel comprising:

a second curved surface along a bottom end of the first wall panel, wherein the second curved surface is configured to rotate relative to the first curved surface, and wherein the second curved surface is configured to mate with the first curved surface; and a second inside surface located inside of the second curved surface, wherein the second inside surface is configured to mate with the first inside surface;

wherein the first floor panel is multisided with a plurality of lateral edges on the top side of the first floor panel, wherein along each lateral edge of the plurality of lateral edges of the first floor panel is another first curved surface and another inside surface located inside of each respective first curved surface;

further comprising a plurality of wall panels, wherein:

each wall panel of the plurality of wall panels comprises:

another second curved surface along the bottom end of the wall panel; and another second inside surface located inside of the second curved surface; and wherein each wall panel of the plurality of wall panels is interchangeable in that the second curved surface along the bottom end of any wall panel of the plurality of wall panels can mate with the first curved surface along any lateral edge of the plurality of lateral edges of the first floor panel;

further comprising a first ceiling panel wherein the first ceiling panel and the first floor panel are interchangeable, whereby the first ceiling panel is multisided with a plurality of lateral edges on a bottom side of the first ceiling panel, wherein along each lateral edge of the plurality of lateral edges of the first ceiling panel is another first curved surface and another first inside surface located inside of each respective first curved surface;

wherein each wall panel of the plurality of wall panels further comprises:

another second curved surface located along a top end of the wall panel, wherein each respective second curved surface along the top end of the wall panel is configured to mate with a respective first curved surface along any edge on the bottom side of the first ceiling panel; and another second inside surface located inside of each respective second curved surface at the top end of the wall panel, wherein each respective second inside surface at the top end of the wall panel is configured to mate with each respective first inside surface along any edge on the bottom side of the first ceiling panel;

wherein the first floor panel, a set of wall panels of the plurality of wall panels, and the first ceiling panel interconnect to form a single shelter unit;

wherein the first floor panel further comprises a plurality of support blocks on a bottom side of the first floor panel, wherein each support block of the plurality of support blocks on the bottom side of the first floor panel accommodates a jack for raising and lowering the support block to level the first floor panel;

wherein the first ceiling panel further comprises a plurality of support blocks on a top side of the first ceiling panel, wherein each support block of the plurality of support blocks on the top side of the first ceiling panel mates with a support block of a plurality of support blocks on a bottom side of a second floor panel;

the method comprising:

placing the first floor panel down with the top side of the first floor panel up;

placing the second curved surface of the first wall panel, proximal to the first curved surface with the top end of the first wall panel tipped back away from the first floor panel;

rotating the first wall panel upward with the second curved surface proximal to the first curved surface until the first wall panel is vertical over the first floor panel whereby the second curved surface slips into the first curved surface until the second inside surface of the first wall panel mates with the first inside surface of the first floor panel;

repeating the above steps of the method with additional wall panels of the plurality of wall panels at each of the plurality of lateral edges of the first floor panel;

placing the first ceiling panel with the bottom side down onto the top end of each wall panel to form the single shelter unit;

repeating each of the above steps of the method with the second floor panel and a second ceiling panel to form another single shelter unit; and stacking the single shelter units into a stacked double shelter unit with the second floor panel over the first ceiling panel whereby each support block of the plurality of support blocks on the top side of the first ceiling panel is mated with a support block of a plurality of support blocks on a bottom side of the second floor panel.

2. The method of claim 1, wherein each first curved surface is concave and each second curved surface is convex; or each first curved surface is convex and each second curved surface is concave.

3. The method of claim 1 further comprising at least one deformable seal, wherein the at least one deformable seal is attached to one or both of the first curved surface and the second curved surface and wherein during the step of rotating the first wall panel, the deformable seal is deformed and seals the interconnection between the first wall panel and the first floor panel.

* * * * *